US006112342A

United States Patent [19]

Breda

[11] Patent Number: 6,112,342

[45] **Date of Patent: *Sep. 5, 2000**

[54] DIVERTER VALVES WITH INTEGRAL BACK FLOW PREVENTER AND INLET AND OUTLET CHECK VALVE MECHANISMS AND IMPROVEMENTS THEREFOR

[75] Inventor: Silvano Breda, Downsview, Canada

[73] Assignee: Silvano Breda, Downsview, Canada

[ * ] Notice: This patent is subject to a terminal disclaimer.

[21] Appl. No.: 09/203,399

[22] Filed: Dec. 2, 1998

Related U.S. Application Data

[60] Division of application No. 09/030,922, Feb. 26, 1998, Pat. No. 5,970,534, which is a continuation-in-part of application No. 08/800,165, Feb. 13, 1997, Pat. No. 5,901,735, which is a division of application No. 08/391,558, Feb. 21, 1995, Pat. No. 5,685,330.

[51] Int. Cl.[7] ..... E03L 1/02; F16K 11/076

[52] U.S. Cl. ..... 4/541.1; 4/676; 137/218; 137/454.2; 137/625.46

[58] Field of Search ..... 4/541.1, 676; 137/218, 137/454.2, 625.46

[56] References Cited

U.S. PATENT DOCUMENTS 4,589,438 5/1986 Breda ..... 137/218
4,979,530 12/1990 Breda ..... 137/454.2 X
5,076,319 12/1991 Salley ..... 4/541.1 X
5,685,330 11/1997 Breda ..... 137/218

*Primary Examiner*—Gerald A. Michalsky
*Attorney, Agent, or Firm*—Neil H. Hughes; Ivor M. Hughes; Marcelo K. Sarkis

[57] ABSTRACT

A cartridge for a valve housing having outlets, the cartridge comprising a stationary body sleeve for fixed insertion within the housing and having outlet ports permanently aligned with the outlets of the housing, a moveable substantially hollow stem sleeve inserted within the stationary body sleeve and having an opening selectively alignable with the ports of the stationary body sleeve, the body sleeve and hollow stem being connected to one another by a retaining ring which aligns and maintains the cartridge as a unit in the housing. The diverting valve may be installed as a deck mounted fixture in a tub, whirlpool, soaking bath, spa, roman tub, or the like wherein the tub spout is located below the flood line rim of the respective fixture wherein the diverting valve can be repaired by replacing the cartridge from the top of the valve by removing the handle and replacing the cartridge in its entirety.

7 Claims, 24 Drawing Sheets

DIVERTER VALVES WITH INTEGRAL BACK FLOW PREVENTER AND INLET AND OUTLET CHECK VALVE MECHANISMS AND IMPROVEMENTS THEREFOR

This application is a division of U.S. patent application Ser. No. 09/030,922, filed Feb. 26, 1998, now U.S. Pat. No. 5,970,534, which is a continuation-in-part of U.S. patent application Ser. No. 08/800,165, filed Feb. 13, 1997, now U.S. Pat. No. 5,901,735, which is a division of U.S. patent application Ser. No. 08/391,558, filed Feb. 21, 1995 now U.S. Pat. No. 5,685,330.

TITLE OF INVENTION

Improvements in Diverter Valves with Integral Back Flow Preventer and Inlet and Outlet Check Valve Mechanisms and Improvements Therefor.

FIELD OF INVENTION

This application relates to a diverter valve with integral, atmospheric type vacuum breaker and inlet and outlet check valves which finds particular application to deck mounted installations such as a roman tub. In particular, the diverting valve finds application in a deck mounted tub with an overflow below the flood level rim of the fixture. Unique installations may therefore be adapted for use with this unique valve.

BACKGROUND OF THE INVENTION

Back flow preventers and check valves are used in commercial and household installations, for example, bidets, Roman tubs, barber shop and hairdressing salon fixtures, laboratory sinks, food processing facilities, chemical manufacturing, metal plating facilities and all types of plumbing applications where the potable water outlet when installed is below the flood level rim of the fixture, just to name a few, to prevent the contamination of the potable water supply. The water in each case is used in different manners and the installation of back flow preventers and check valves would be required for each use to protect the water supply from contamination or a separate back flow preventer and check valve would be installed in the line in advance of the components in the system. For example, in residential installations of a bidet, the water is diverted to the rim or the spray. In a soaking or whirlpool bath tub the water is diverted to the spout, shower head or removable hand-held shower. A number of proposals have been made for the diversion of fluids. Various methods and devices have been used to protect the potable water system from contamination. The premises may be isolated to protect the purveyor's water distribution system by installing a back flow preventer at the water line into the building. An area may be isolated when a portion of the building has toxic material used there. That portion of the building should be isolated by installing a back flow preventer so as to protect the individual consumer using the water within the building. Finally one may individually isolate each fixture or piece of equipment from the water system such as is the case in Applicant's own structure described in Canadian Patent 1,225,006 and U.S. Pat. No. 4,589,438 which provides atmospheric back flow prevention, in a compact, easily manufactured, effective unit. The present invention describes improvements thereto by adding a plurality of checking devices and improves the structure and repair of the diverting valve.

It is well known that any deck mounted faucet with removeable spout or where the water spout outlet is installed below the flood level rim of the fixture that installation is required by law to have a vacuum breaker with check valves. These codes are set out by the ASME, CAN/CSA, IAPMO and CABO/ANSI (ADA) codes. Any installation for which there is risk of contamination to the potable water system. Such installations must meet all codes by providing vacuum breakers and check valves. In doing so, however, there is a considerable amount of cost resulting from installation of individual vacuum breakers with separate checks and the necessary piping to and from all the components along with the labour costs and the continual maintenance costs of such individual components. It would therefore be advantageous to provide all of these features within a cartridge system heretofore unknown. It would be desirable to have deck mounted valves with an integral cartridge accessible from the top for repair without requiring dismantling the deck mounted installation. It would also be advantageous to repair such a cartridge which may malfunction by merely removing such cartridge from the top of the deck simply by removing the diverter valve handle.

It is therefore an object of this invention, to provide a diverter valve with, integral atmospheric type vacuum breaker and inlet and outlet check valves in an integral structure which is entirely reliable and easily serviced from the top.

It is therefore another object of this invention to provide a deck-mounted tub installation wherein the spout is an integral part of the overflow and is below the flood level rim of the fixture including a diverter valve which meets all of the code requirements set out above.

It is a further object of this invention to provide a multiple deck mounted tub installation system including a diverter valve with integral atmospheric-type vacuum breaker and inlet and outlet check valves which conform with all codes and is economical and practical to acquire and maintain.

Further and other objects of the invention will be realized by those skilled in the art from the following summary of the invention and detailed description of preferred embodiments thereof.

SUMMARY OF THE INVENTION

According to a primary aspect of the invention, there is provided a diverter valve with integral back flow preventer and inlet and outlet check valves comprising a housing having two ends, one end for receiving a valve cartridge in use and preferably having detents provided proximate that end, the housing having an outer wall and an inner wall, the inner wall defining an opening extending from proximate one end to proximate the other end of the housing, the housing having an inlet port, preferably extending from one end of the housing toward the cartridge receiving end of the housing and into the housing opening, the housing having at least two outlet ports, preferably extending through the housing from the outer wall to the inner wall into said housing opening, preferably said at least two outlet ports being directed on the same plane and opening into the housing opening; a stationary body sleeve having a first end and preferably having detents disposed proximate the first end for locking a preferred retaining ring in position and a second end and an inner and outer wall defining a chamber, the second end of the body sleeve for insertion within the housing opening to proximate the inlet port in use, the body sleeve having an integral inlet tube within the chamber in communication with the inlet port of the housing in use and extending a predetermined distance in the chamber from the inlet port of the housing towards the cartridge receiving end of the housing and beyond the first end of the body sleeve to an open end, the open end of the inlet tube having disposed therewith a check to allow flow out of the open end but not back into the open end of the inlet tube, the chamber of body sleeve being defined by the outer wall of the inlet tube and the inner wall of the body sleeve, the body sleeve having disposed therewith openings extending from the chamber to the outer wall of the body sleeve and in direct communication with the at least two outlet ports of the housing, some of the openings of the body sleeve being provided with a check which allows flow out from the chamber toward the ports of the housing but prevents any flow from the ports to the chamber, in a preferred embodiment at least one of said openings further comprise a plurality of radially disposed small openings working in cooperation with a check which is preferably a disk shaped seal with integral seal portions proximate the circumference thereof to seat within the outer wall of the body sleeve and having a central opening to allow flow from the plurality of radially disposed small openings from the chamber to the housing outlet ports, and having a sealing surface disposed proximate each of the plurality of radially disposed openings to prevent any flow from the outlet ports of the housing to the chamber; a moveable diverting stem having a first open end and a second vented end wherein a handle is disposed in use and having an inner and outer wall, preferably the outer wall having provided therewith a detent for engagement with a stop of the preferred retaining ring which retains the moveable diverting stem and stationary body sleeve in engagement with one another, the first and second ends of the moveable stem providing therebetween a hollow wherein is disposed the open end of the inlet tube and the check thereof in use, preferably the check further comprising a resilient member tapering outwardly away from the inlet tube toward the inner wall of the moveable stem thereby allowing flow from the inlet tube to the chamber yet preventing flow from the chamber into the open end of the inlet tube, the first end of the stem for insertion within the chamber of the stationary body sleeve, surrounding the integral inlet tube, to proximate the end of the inlet tube proximate the inlet port of the housing, the diverting stem having disposed proximate the first open end a single opening (preferably provided with a seat for a seal surrounding the opening) for selected communication with the openings of the stationary body sleeve; a closure reciprocal from a position spaced from the open end of the inlet tube and check closing the upper end of the diverter valve to the atmosphere, to a position closing the inlet tube of the diverter valve to atmosphere, whereby when fluid is fed through the inlet tube into the valve the closure is moved away from the open end of the inlet tube closing the valve to atmosphere to permit the fluid to pass out the open end of the inlet tube into the valve, and when fluid is not passed through the inlet tube, the closure closes the open end of the inlet tube and vents the valve to atmosphere, wherein when assembled the stem sleeve maybe selectively moved to communicate the single opening of the stem sleeve with the openings of the stationary body sleeve and fluid will flow to the selected outlet port of the housing, for example to a spout, shower head or removable hand-held shower.

According to another aspect of the invention, there is provided a diverter valve with integral atmospheric type vacuum breaker and inlet and outlet check valves and for connection to a faucet or other valve which faucet or other valve controls water flow to the diverter valve, a housing having two ends, one end for receiving a valve cartridge in use and having detents provided proximate that end, the housing having an outer wall and an inner wall, the inner wall defining an opening extending from proximate one end to proximate the other end of the housing, the housing having an inlet port, preferably extending from one end of the housing toward the cartridge receiving end of the housing and into the housing opening, the housing having at least two outlet ports, preferably extending through the housing from the outer wall to the inner wall into said housing opening, preferably said at least two outlet ports being directed on substantially the same plane and opening into the housing opening; a stationary body sleeve having a first end preferably having detents disposed proximate the first end preferably for locking a retaining ring in position and a second end and an inner and outer wall defining a chamber, the second end of the body sleeve for insertion within the housing opening to proximate the inlet port in use, the body sleeve having an integral inlet tube within the chamber in communication with the inlet port of the housing in use and extending a predetermined distance in the chambers from the inlet port of the housing towards the cartridge receiving end of the housing and beyond the first end of the body sleeve to an open end, the open end of the inlet tube having disposed therewith a check to allow flow out of the open end but not back into the open end of the inlet tube, the chamber of body sleeve being defined by the outer wall of the inlet tube and the inner wall of the body sleeve, the body sleeve having disposed therewith openings extending from the chamber to the outer wall of the body sleeve and in direct communication with the least two outlet ports of the housing, the openings of the body sleeve being provided with a check which allows flow out from the chamber toward the outlet ports of the housing but prevents any flow from the outlet ports to the chamber, in a preferred embodiment said openings further comprise a plurality of radially disposed small openings working in cooperation with a check which is preferably a disk shaped seal with integral seal proximate the circumference thereof to seat within the outer wall of the body sleeve and having a central opening to allow flow from the plurality of radially disposed small openings from the chamber to the housing outlet ports, and having a sealing surface disposed proximate each of the plurality of radially disposed openings to prevent any flow from the outlet ports of the housing to the chamber; a moveable diverting stem having a first open end and a second vented end wherein a handle is disposed in use and having an inner and outer wall, preferably the outer wall having provided therewith a detent for engagement with a stop of the preferred retaining ring which retains the moveable diverting stem and stationary body sleeve in engagement with one another, the first and second ends of the moveable stem providing therebetween a hollow wherein is disposed the open end of the inlet tube and the check thereof, preferably the check further comprising a resilient member tapering outwardly away from the inlet tube toward the inner wall of the moveable stem thereby allowing flow from the inlet tube to the chamber yet preventing flow from the chamber into the open end of the inlet tube, the first end of the stem for insertion within the chamber of the stationary body sleeve, surrounding the integral inlet tube, to proximate the end of the inlet tube proximate the inlet port of the housing, the diverting stem having disposed proximate the first open end a single opening (preferably provided with a seat for a seal surrounding the opening) for selected communication with the openings of the body sleeve; a closure reciprocal from a position spaced from the open end of the inlet tube and check closing the upper end of the diverter valve to the atmosphere, to a position closing the inlet tube of the diverter valve to atmosphere, whereby when fluid is fed through the inlet tube into the valve the closure is moved away from the opening in the inlet tube closing the valve to atmosphere to permit the fluid to pass out the opening of the inlet tube into the valve, and when fluid is not passed through the inlet tube, the closure closes the open end of the inlet tube and vents the valve to atmosphere, wherein when assembled the stem sleeve maybe selectively moved to communicate the single opening of the stem sleeve with the openings of the stationary body sleeve and fluid will flow to the selected outlet, for example to a spout, shower head or removable hand-held shower.

According to another aspect of the invention, the moveable stem may further comprise a tube having an outer surface whose dimensions correspond substantially to the inner surface dimensions of the inner wall of the body sleeve defining the chamber and providing an intimate close tolerance fit therebetween yet allowing movement of the stem within the body sleeve.

According to yet another aspect of the invention there is provided a cartridge for a valve housing having outlets, the cartridge comprising a stationary body sleeve for fixed insertion within the housing and having outlet ports permanently aligned with the outlets of the housing, a moveable substantially hollow stem sleeve inserted within the stationary body sleeve and having an opening selectively alignable with the ports of the stationary body sleeve, the body sleeve and hollow stem being connected to one another by a retaining ring which aligns and maintains the cartridge as a unit in the housing. Preferably the retaining ring includes stops to limit the travel of the moveable hollow stem and preferably engageable with a detent provided with the exterior of the hollow stem, preferably the housing and the retaining ring include detent portions to fix the position of the body sleeve with respect to the housing while allowing motion of the moveable stem within the limits of the stops provided. In a preferred embodiment the cartridge, and the cartridge components are structured substantially as described in the first two paragraphs of this summary of invention.

According to yet another aspect of the invention, there is provided a diverter valve with integral vacuum breaker back flow preventer and inlet and outlet check valves comprising a housing having two ends, one end for receiving a valve cartridge in use, the housing having an outer wall and an inner wall, the inner wall defining an opening extending from proximate one end to proximate the other end of the housing, the housing having an inlet port, the housing having at least two outlet ports; a stationary body sleeve having a first end and a second end and an inner and outer wall defining a sleeve opening, the second end of the body sleeve for insertion within the housing opening to proximate the inlet port in use, the body sleeve having an inlet within the sleeve opening in communication with the inlet port of the housing and extending a predetermined distance in the sleeve opening from the inlet port of the housing towards the cartridge receiving end of the housing to an open end, the inlet port having disposed therewith a check to allow flow from the inlet port but not back to the inlet port, the body sleeve having disposed therewith openings extending from the sleeve opening to the outer wall of the body sleeve and in direct communication with the at least two outlet ports of the housing, some of the openings of the body sleeve having been provided with a check which precludes reversal of flow into the valve; a moveable diverting stem having a first open end and a second vented end wherein a handle is disposed in use and having an inner and outer wall, the first and second ends of the moveable stem providing therebetween a hollow stem chamber wherein is disposed the waterway in use, the first end of the diverting stem for insertion within the sleeve opening of the stationary body sleeve, to proximate the inlet port of the housing, the diverting stem having disposed proximate the first open end a single opening for selected communication with the openings of the stationary body sleeve; a closure moveable from a position spaced from the open end of the stem chamber closing the upper end of the diverter valve to the atmosphere, to a position closing the stem chamber of the diverter valve to atmosphere, whereby when fluid is fed through the valve the closure is moved away from the open end of the stem chamber closing the valve to atmosphere to permit the fluid to pass into the valve, and when fluid is not passed through the stem chamber, the closure opens the open end of the stem chamber to atmosphere and vents the valve to atmosphere, wherein when assembled the stem may be selectively moved to communicate the single opening of the stem with the openings of the stationary body sleeve and fluid will flow to the selected outlet port of the housing, for example to a spout, shower head or removable hand-held shower.

According to yet another aspect of the invention there is provided a deck-mounted diverting valve with integral vacuum breaker, back flow preventer and inlet and outlet check valves for diverting premixed water from at least one supply valve to one of at least two and preferably at least three tub accessories, (for example shower nozzles, spouts, jets, hand-held shower nozzles, body shower nozzles, pumps, disinfectant circuits or the like), said diverting valve comprising:

a housing having an opening for receiving a cartridge, said housing having an inlet to receive water from the at least one supply valve, and at least two and preferably at least three outlets, at least one of said outlets being a primary outlet (for example full capacity flow from the valve to be coupled to a spout) and the remaining auxiliary outlets being restricted in flow, (for example to supply a telephone shower, body shower and other accessories), said cartridge having an inlet port and at least two and preferably three outlet ports, said cartridge including a vacuum breaker and a check on the inlet port to said cartridge, and having a rotatable member for selective alignment of one of the at least two and preferably three outlet ports with one of the at least two and preferably at least three outlets of the housing; some of said outlet ports, and preferably said auxiliary ports having checks provided therewith and having flows of restricted volume compared to the flow capacity of the primary outlet of the valve, at least one of said at least two and preferably at least three of said outlets ports being the primary port and providing full capacity flow to one of the at least two and preferably three outlets of said valve, wherein said rotatable member of said cartridge may be selectively aligned with one of the desired housing outlets without turning off the water supply. In a preferred embodiment the diverting valve meets all ASME, CAN/CSA, IAPMO and CABO/ANSI (ADA) codes which effectively requires, for deck mounted installations with water paths to overflow, jet or any other type of outlet located below the flood level rim of the fixture, a vacuum breaker and check valves. For all outlets to the tub the above-mentioned diverting valve structure will provide these code requirements which are provided internally within the valve without the need for external checks on the outlets from the valve with the exception of the full flow outlet port wherein an external check may be installed depending on the installation.

According to yet another aspect of the invention there is provided a cartridge for a valve housing having outlets, the cartridge comprising a stationary body sleeve for fixed insertion within the housing and having outlet ports permanently aligned with the outlets of the housing, a moveable substantially hollow stem sleeve inserted within the stationary body sleeve and having an opening selectively alignable with the ports of the stationary body sleeve, the body sleeve and hollow stem being connected to one another by a retaining ring which aligns and maintains the cartridge as a unit in the housing.

In a preferred embodiment the diverting valves embodying the invention as described above may be installed as a deck mounted fixture in a tub, whirlpool, soaking bath, spa, roman tub, or the like wherein the tub spout is located below the flood line rim of the respective fixture. In such a situation the building code requires prevention of contamination of the potable water system. The present embodiments of the diverter valve meets these code requirements by providing a vacuum break back flow preventer and check on the inlet to the valve, and checks on some of the outlets of the valve, all contained within the cartridge. Further, the diverting valve can be repaired by replacing the cartridge from the top of the valve by removing the handle and replacing the cartridge in its entirety. If the valve fails for some reason, a leak will be evident from the vacuum breaker under the handle. The prior art structures do not normally "show" this condition without the surrounding wall being damaged.

According to a preferred embodiment of the invention the deck mounted diverting valve may be installed in a tub assembly further comprising a spout, the rotatable member or stem for selective alignment of the primary outlet port of said cartridge and said spout, or said rotatable member or stem for selective alignment of one of an auxiliary outlet of said cartridge and a hand-held shower or a body shower. Preferably the flow to the spout is up to substantially thirty gallons per minute, and the flow to the hand-held shower and the auxiliary outlet is substantially up to eleven gallons per minute at sixty pounds per square inch line pressure.

According to another embodiment of the invention, the deck mounted diverting valve may be installed in a tub assembly further comprising a waste overflow having an inlet to the tub positioned within the waste overflow and for selective alignment with the primary outlet port of said cartridge, a hand shower nozzle being disposed at each end of said tub and for selective alignment with one of the auxiliary outlets of said cartridge. Preferably the flow to the waste overflow is up to substantially thirty gallons per minute, and the flow to the hand-held shower is substantially up to eleven gallons per minute at sixty pounds per square inch line pressure.

According to another embodiment of the invention, the deck mounted diverting valve may be installed in a tub assembly having a top and bottom further comprising a high volume jet nozzle, preferably positioned proximate the bottom of said tub, for selective alignment with the primary outlet port of said cartridge, preferably a low volume jet nozzle being positioned intermediate the top and bottom of the tub above the horizontal plane of the high volume jet nozzle for selective alignment with one of the auxiliary outlet ports of said cartridge, and preferably a hand-held shower nozzle for selective alignment with one of another of said auxiliary outlet ports of said cartridge. Preferably the flow to said high volume jet is up to substantially thirty gallons per minute, and the flow to the low valve jet nozzle and the hand-held shower nozzle is substantially up to eleven gallons per minute at sixty pounds per inch line pressure. By utilizing the high and low volume jets, the user can refresh the tub water with hot water below the waterline to provide much more uniform mixing of the water and comfort to the bather providing a more uniform water temperature throughout the water contained in the tub as opposed to the water temperature of a tub of water filled only from the top through a spout. The same maximum flow capacities apply as discussed above.

According to another embodiment of the invention, the deck mounted diverting valve may be installed in a tub assembly further comprising a whirlpool pump having an inlet and an outlet whose inlet is for selective alignment with the primary outlet port of said cartridge, wherein a check is provided in the connection between said pump and said outlet port of said cartridge, the outlet of said pump being connected to a predetermined number of whirlpool jets disposed in said tub and the inlet of said pump being connected to a suction port provided in said tub to circulate the water in a conventional manner, preferably a hand-held shower nozzle is provided for selective alignment with all remaining auxiliary outlets of said cartridge to prevent stagnant water from accumulating, or alternatively an additional body shower nozzle is also provided for selective alignment with an auxiliary outlet of said cartridge. An auxiliary check valve is provided on the supply line to the pump to prevent contamination of the potable water. The same flow capacities are available as discussed above. This installation may be utilized to sterilize the tub following hospital uses such as water births, while preventing contamination and back flow to potable water. Alternatively, a disinfectant dispenser including a circuit may be utilized with the above-mentioned installation wherein in this embodiment the body shower nozzle is replaced by a disinfectant container on the low volume auxiliary line for selective alignment with an auxiliary outlet port of the cartridge. A check is also provided in the auxiliary line to protect the water supply backing up from the pump. The disinfectant may be provided in a solid disk form and placed in the disinfectant container for one use only. As the water passes through the container, the disinfectant is dissolved and fed directly to the pump outlet and whirlpool jets and coincidentally to the tub without the pump running if desired. The tub may therefore easily be disinfected after each use as required in hotels, hospitals and other institutions. The same flow rates apply as discussed above.

The invention will now be illustrated with reference to drawings of embodiments of the invention.

DETAILED DESCRIPTION OF PREFERRED EMBODIMENTS OF THE INVENTION

Figure 1:
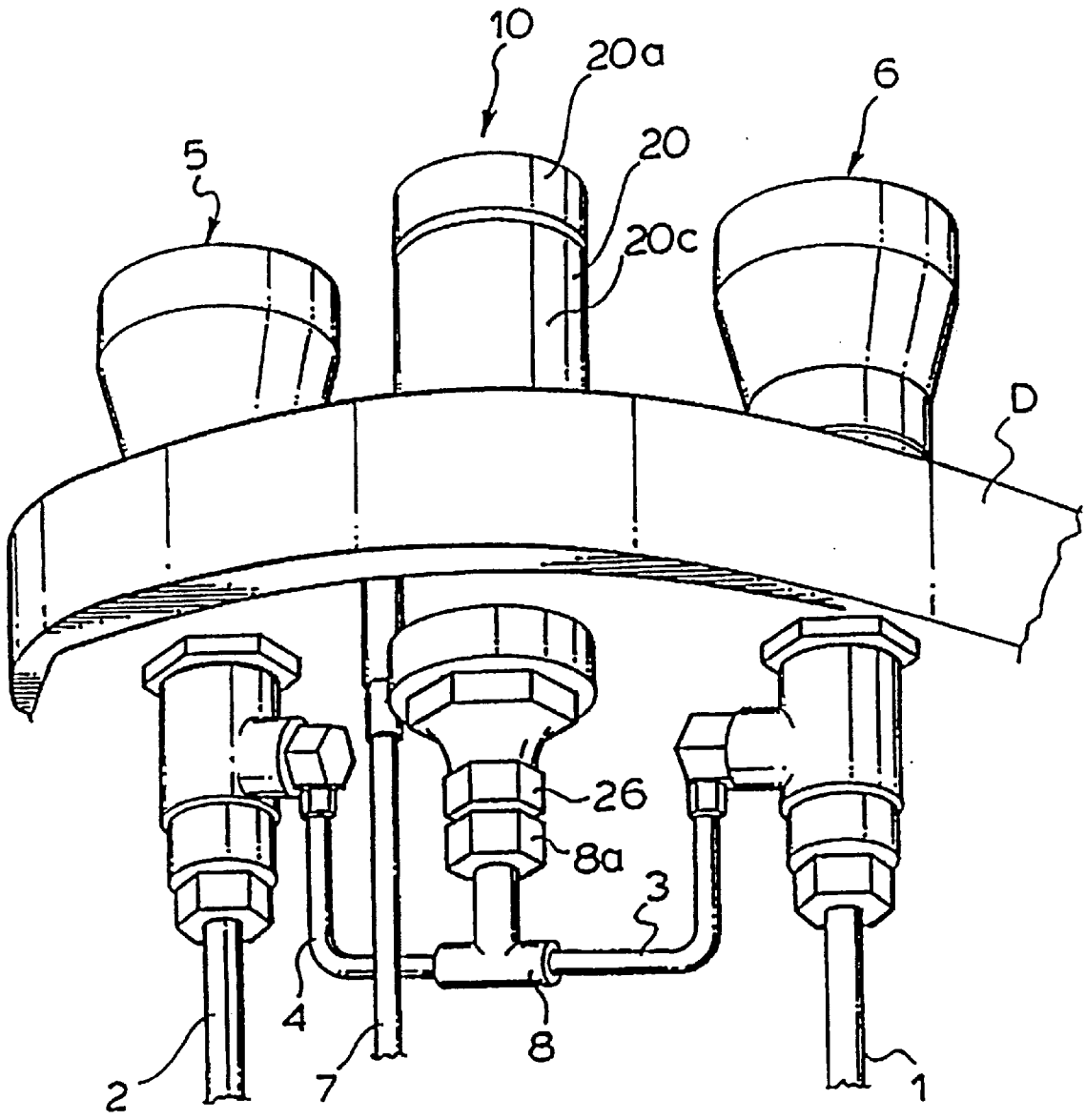
FIG. 1 is a general perspective view of the use of the Diverter Valve embodying the invention and illustrated in a preferred embodiment of the invention.

Similarly as taught in my Canadian Patent 1,225006 there is illustrated a Diverter Valve 10 which is installed on for example a deck D for a roman tub to receive hot and cold water from valve mechanisms 5 and 6 which provide hot or cold water and variations of the flow and mixtures thereof to the diverting valve 10. For this example valve 5 will supply hot water and valve 6 will supply cold water. Therefore the supply tubing 1 and 2 are providing cold water into the bottom of faucet valve 6 and hot water into the bottom of faucet valve 5. Cold and hot water are therefore inlet to the bottom of the Diverting Valve 10 via tubes 3 and 4 and fitting 8 to inlet coupling 8*a* and inlet 26 of the housing 20 of the Diverting Valve 10. By rotating the handle 20*a* of the housing 20 the user may select with this embodiment one of three positions; a spout to the tub(not shown), a fixed wall shower head (not shown), a supply tubing 7 extending to a hand held shower unit, (also not shown). Alternatively any other alternative fixtures may be provided for which back flow prevention is desired.

Figure 2:
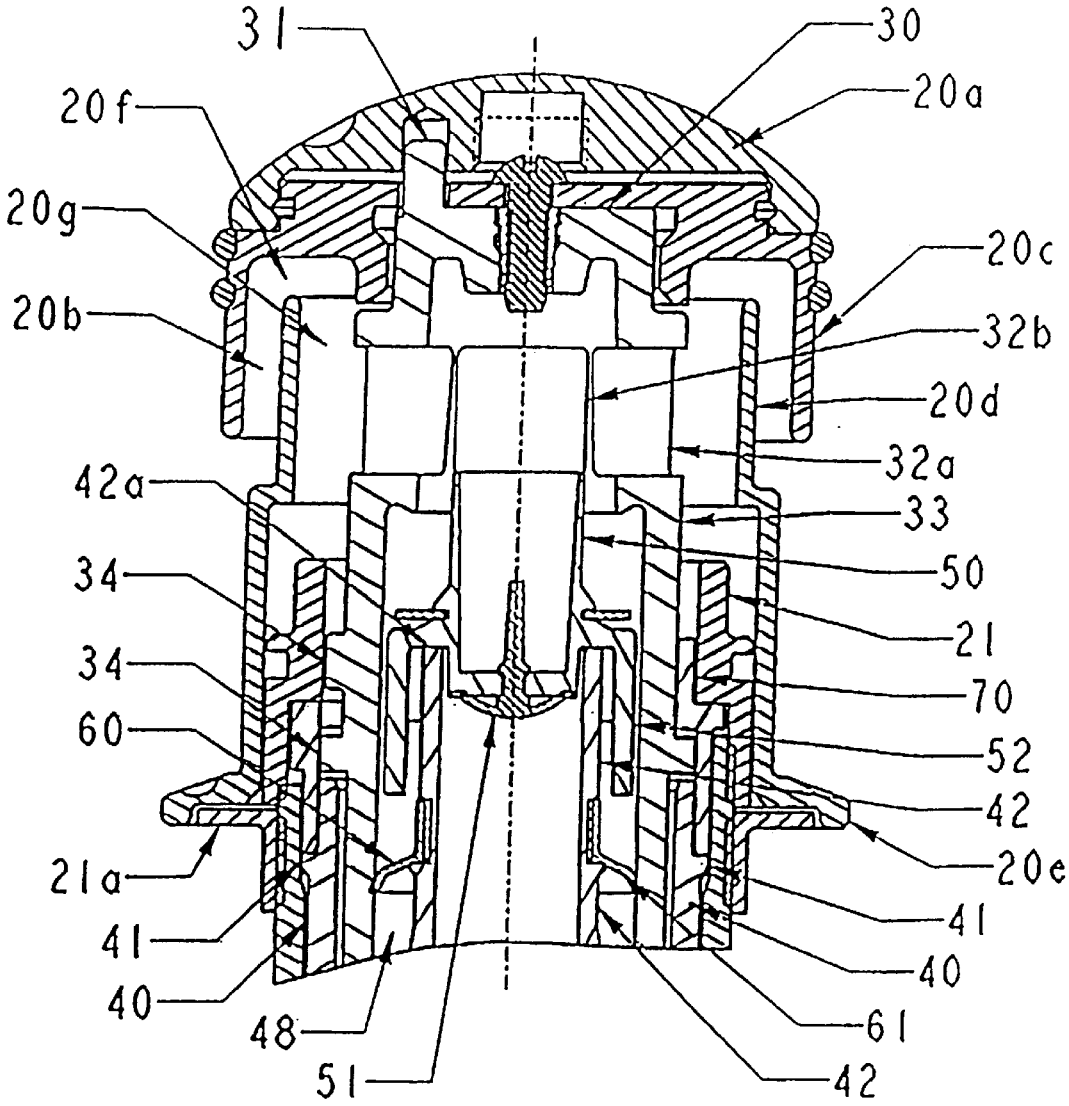
FIG. 2 and 3 are cut away sectional views of the components making up the diverted valve and illustrated in a preferred embodiment of the invention.
Figure 3:
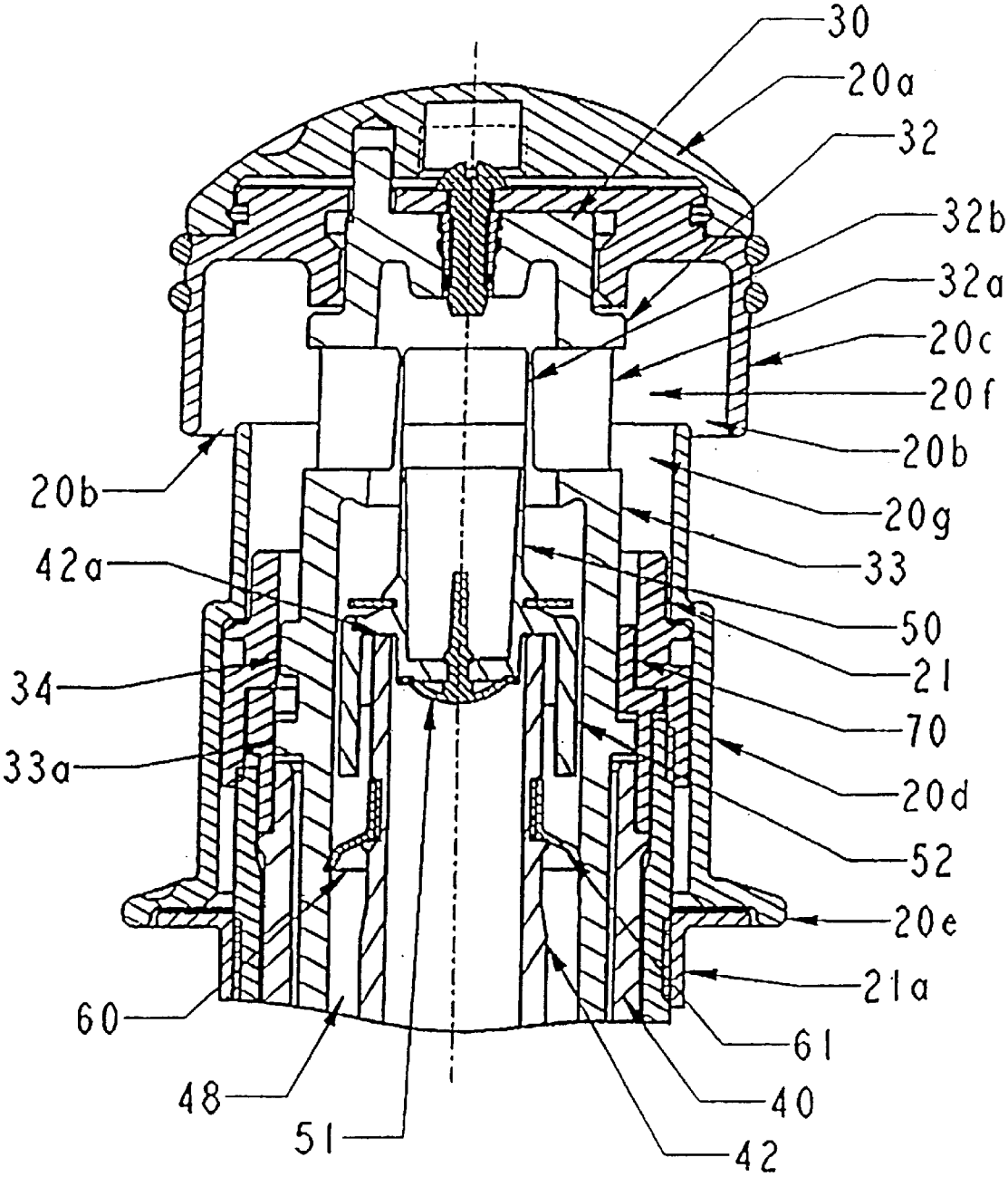
Figure 4:
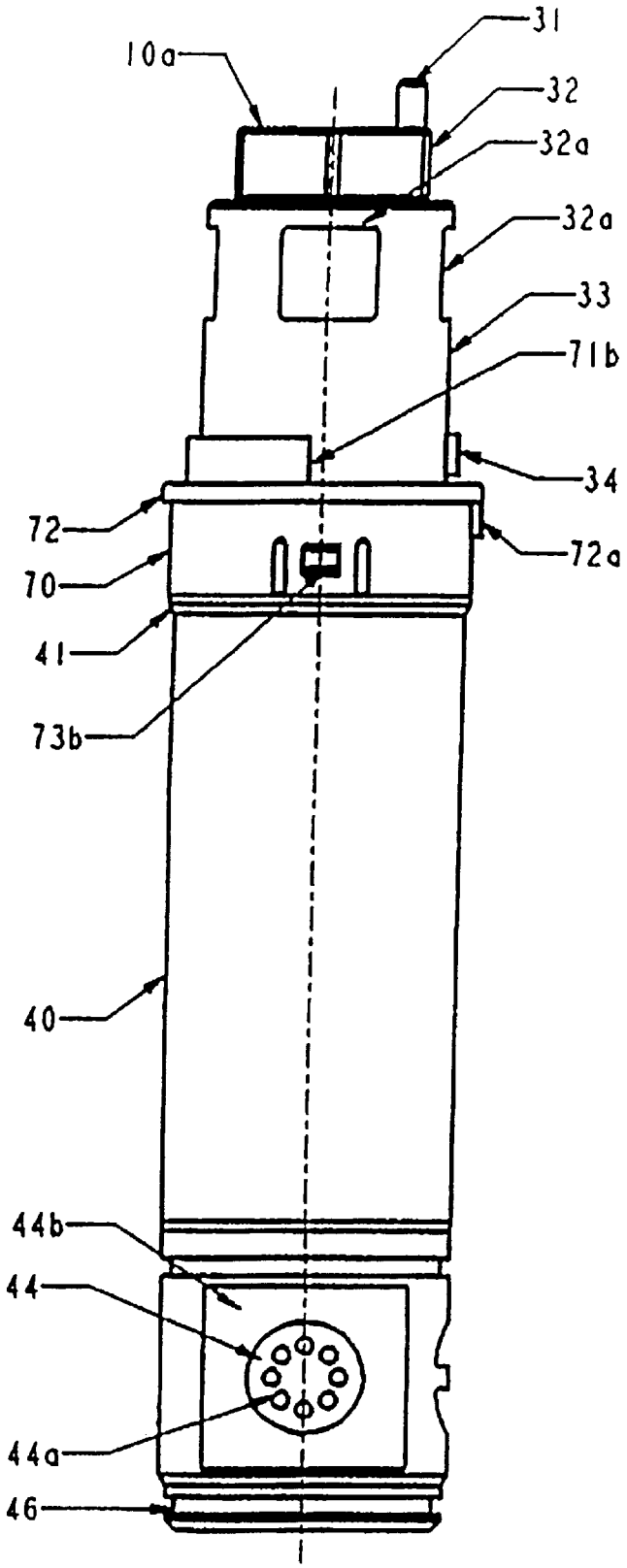
FIGS. 4, 4*a*, and 4*b* are illustrations of the cartridges installed in the Diverter Valve illustrating the various outlet positions of the cartridge and illustrated in a preferred embodiment of the invention.
Figure 4A:
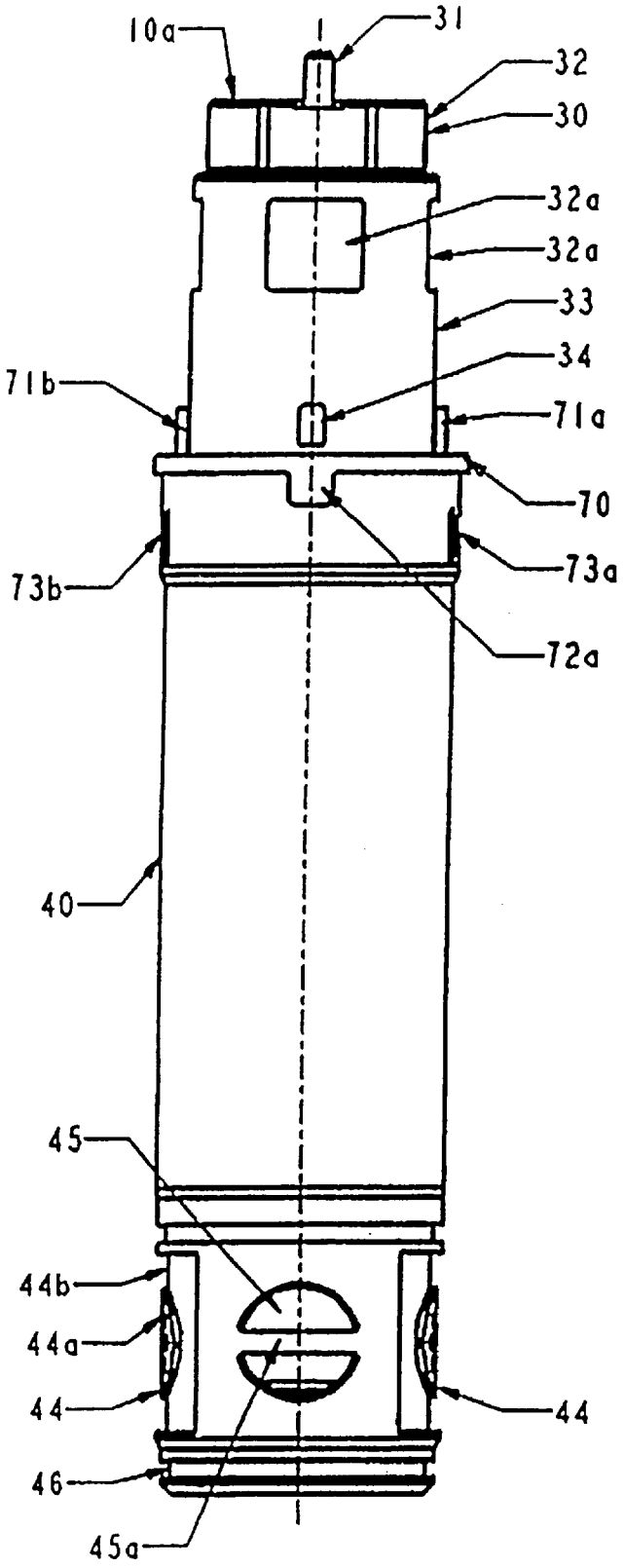
Figure 4B:
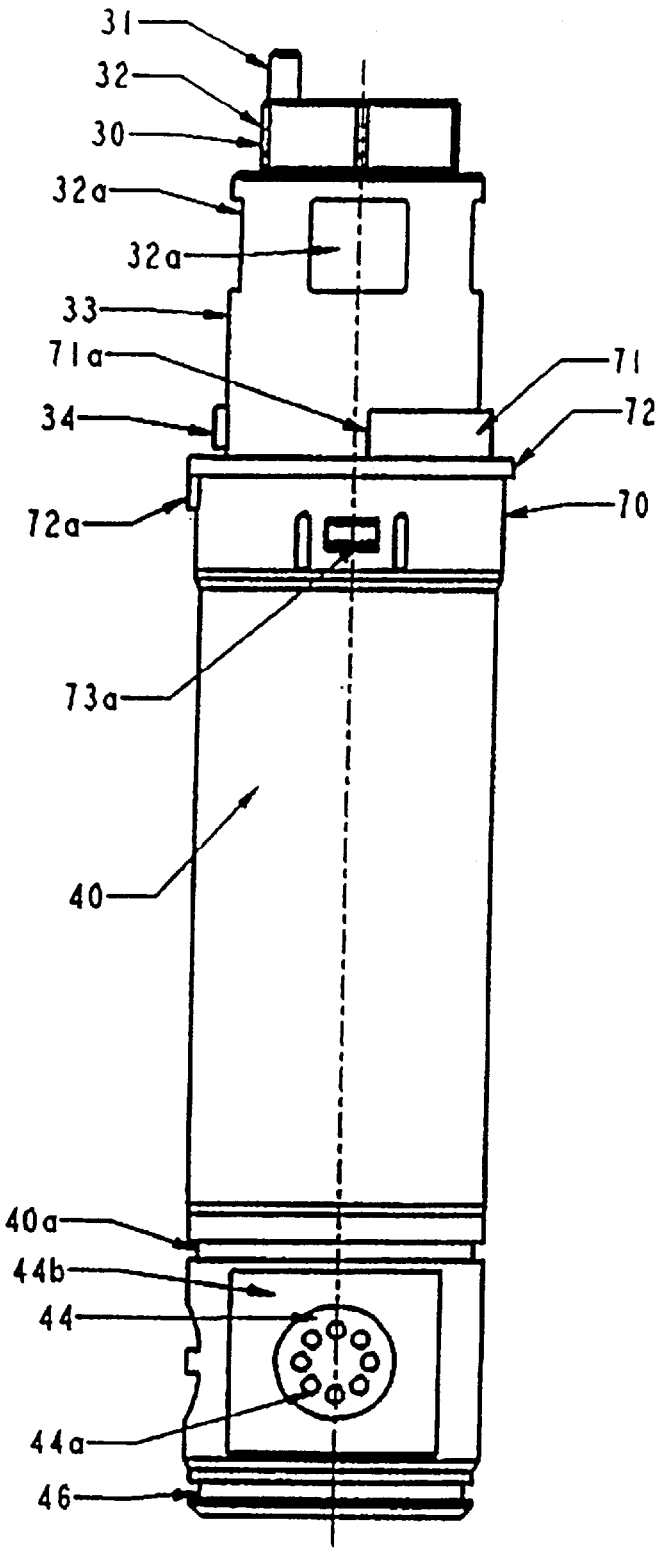

Referring now to FIGS. 2 and 3 there is illustrated the installation of the components of the handle and the assembly of the trim for the valve and the components of the valve. Therefore there is provided a control handle 20*a* attached to the Diverting stem 30 having an engaging portion 31 which engages with the opening proximate the bottom of the handle portion 20*a* as shown. The handle portion 20*a* includes venting portions 20*f* to allow the valve to vent to atmosphere when not in operation. To enable this to occur a float 50 is provided which is moved from a position as illustrated closing the inlet tube 42 of the stationary body sleeve 40 of the valve assembly to a position closing the vent 32*b* of the valve assembly thereby allowing water into the chamber 48. The Diverting stem 30 therefore is moveable within the stationary body sleeve 40 which are held together as an integral package by a retaining ring 70 as best seen in FIGS. 4, 4*a*, and 4*b*. A trim portion 20*d* extends down to flange portion 21*a* covering thereover via flange portion 20*e* to provide the proper trim for the Diverting valve 10. Integral with the handle portion is a downwardly depending skirt 20*c* which covers the diverting stem 20 and provides for a venting chamber 20*f* and 20*g* which vents the cartridge via the windows 32*a* through the passage 20*g*, 20*f*, and 20*b* out to atmosphere thereby providing a vacuum breaking path. This path of course is closed by the top of float 50 via the movement and sealing of the float 50 in relation to the above mentioned passage as will be described here in after.

The inlet tube 42 therefore is provided with a one way check mechanism 60 proximate the top thereof which is located at a predetermined position below the top end 32*a* of the inlet tube to allow proper functioning of the float mechanism 50 and to provide checking of the fluid flowing from the top of tube 42 to the passage 48 between the tube 42 and the inner wall 40*d* of the stationary sleeve 40. Therefore the fluid will pass one way down into the chamber 48 but will not pass back from the chamber 48 back into the inlet tube 42 thereby providing a check mechanism and protection for the inlet water.

Figure 5:
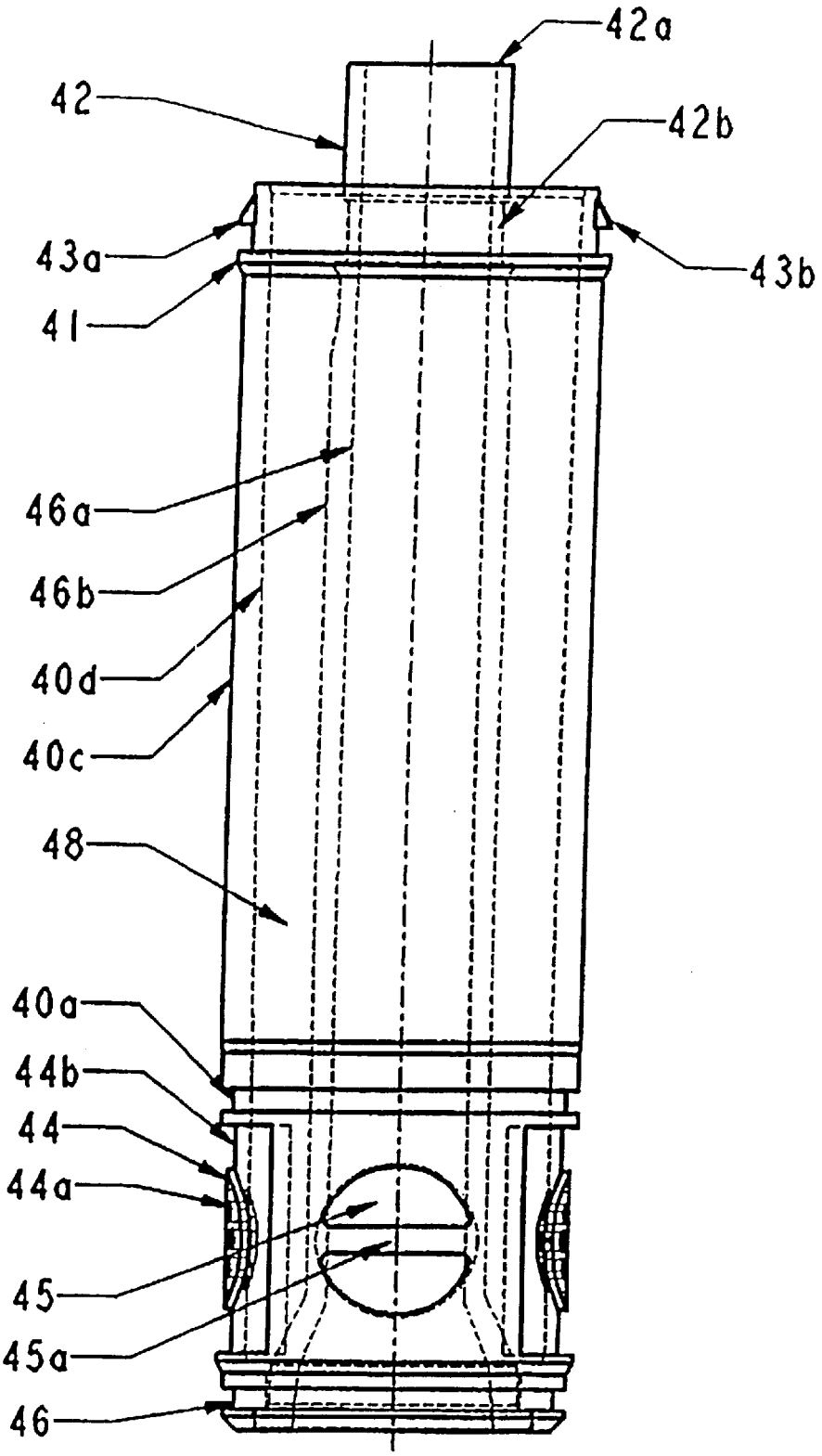
FIGS. 5 and 5*a* are illustrations of the stationary body sleeve and inlet tube illustrating the various outlets of the body sleeve and illustrated in a preferred embodiment of the invention.
Figure 5A:
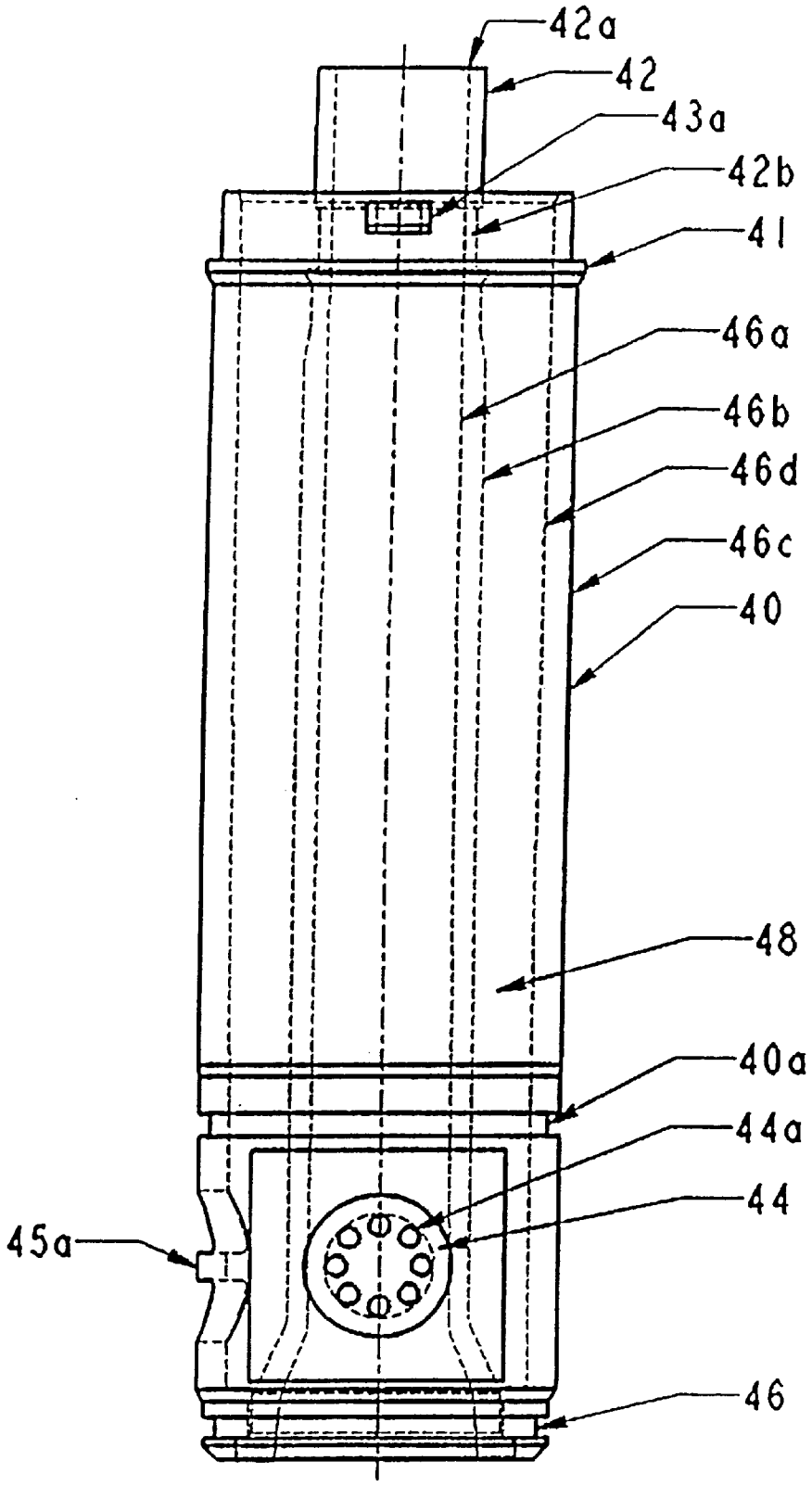

Referring now the FIGS. 4, 4*a*, and 4*b* there is illustrated the cartridge 10*a* of the Diverter Valve 10 comprising the moveable Diverting Stem 30 moveable within the stationary body sleeve 40 and being retained together by retaining portion 70 having locking portions 73*b* and 73*a* which engage with tabs 43*a* and 43*b* respectively of the body sleeve as best seen in FIGS. 5 and 5*a*. The locking ring, as best seen in FIG. 9, and FIGS. 9*a* through 9*f*, includes an opening portion 70*a* to allow the locking ring to rest on the flange 41 of the stationary body sleeve 40 under the flange portion 72 after the opening 70*a* allows passage of detent 34 through said opening 70*a* during assembly thus allowing the bottom of flange 72 to rest on flange 41. The opening 73*b* will engage with the tab portion 43*b* and the opening 73*a* will engage with the tab portion 43*a*.

Figure 12A:
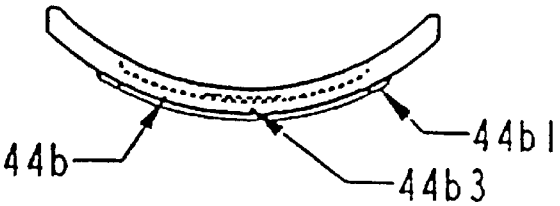
FIGS. 12 and 12*a* shows the generally flat disk design for the check mechanism enclosing the openings 44*a* of the stationary body sleeve 40 and illustrated in a preferred embodiment of the invention.
Figure 12:
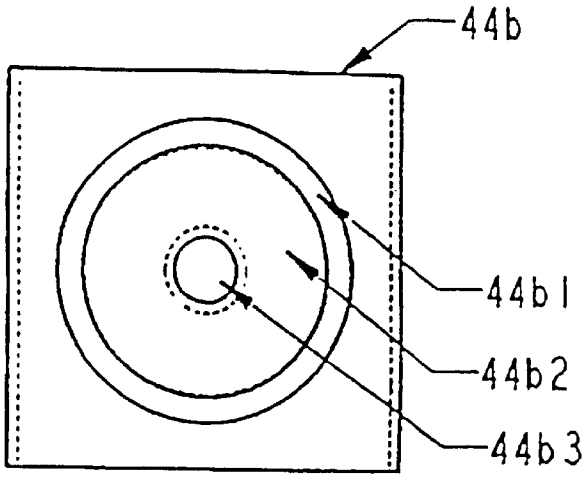

An opening 32*a* provided proximate the top of stem 30 allows venting of the valve as described in relations to FIGS. 2 and 3. The stem 30 therefore is moveable within the body 40 within the limits of the detent 34 and the locking ring 70 as provided by stops 71*b* an 71*a*. These positions therefore provide a full range of selectivity from the openings 44 and the single opening 45. The openings 44 are provided for shower outlets and have reduced volume in relation to opening 45 which includes the reinforcing bar 45*a* to retain the seal from collapsing into the opening 45 as best seen in FIG. 6*a* or from sliding through the opening 45 when the Diverting valve is operated. Typically the opening 45 would lead to the spout for the Roman tub whereas the multiplicity of openings 44*a* would lead to a shower or a telephone shower. A unique check valve 44*b* is provided, as best seen in FIGS. 12 and 12*a*, which seats in the seating provided around the opening 44*a* via the ring 44*b*(1) provided with the gasket 44*b*. When water comes out of opening 44*a* it will pass through opening 44*b*(3) of the check valve 44*b*. However any water attempting to backup into the outlet will be prevented by the occluded face 44*b*(2) of the one way check valve provided. As best seen in FIG. 6*a* a single outlet is provided from the Diverting stem which is typically sealed by an "O" ring 35*a*. Therefore this single outlet is aligned selectively with the outlets 25, 27 or 28 when water is inlet into the valve through inlet 26.

Referring to FIGS. 5 and 5*a* the stationary body sleeve is illustrated having an inlet tube integral therewith at 42 having a top at 42*a* and a check receiving portion 42*b* wherein the check 60 is positioned as best seen in FIG. 6*a*. The stationary body 40 therefore has an outer diameter 40*c* an inner diameter 40*d* a gasket receiving portion 40*a*, and an opening 44, 45 and 46 as previously described. The inlet tube has an inner diameter 46*a* an outer diameter 46*b*. The inner diameter 40*d* of the outer body 40 and the outer diameter 46*b* of the inlet 42 defines a chamber 48*a* where water will pass from the outlet 42*a* of the inlet tube to the chamber passing the check valve 60 (but not passing back to the inlet tube) and then selectively out of one of the openings 44 or 45 and 28, 27, or 25 of the housing 20. This can be best seen in relation to FIGS. 7, 7*a* and 7*b* and the reader is referred to these figures in relations to the aforementioned paragraph.

Figure 6:
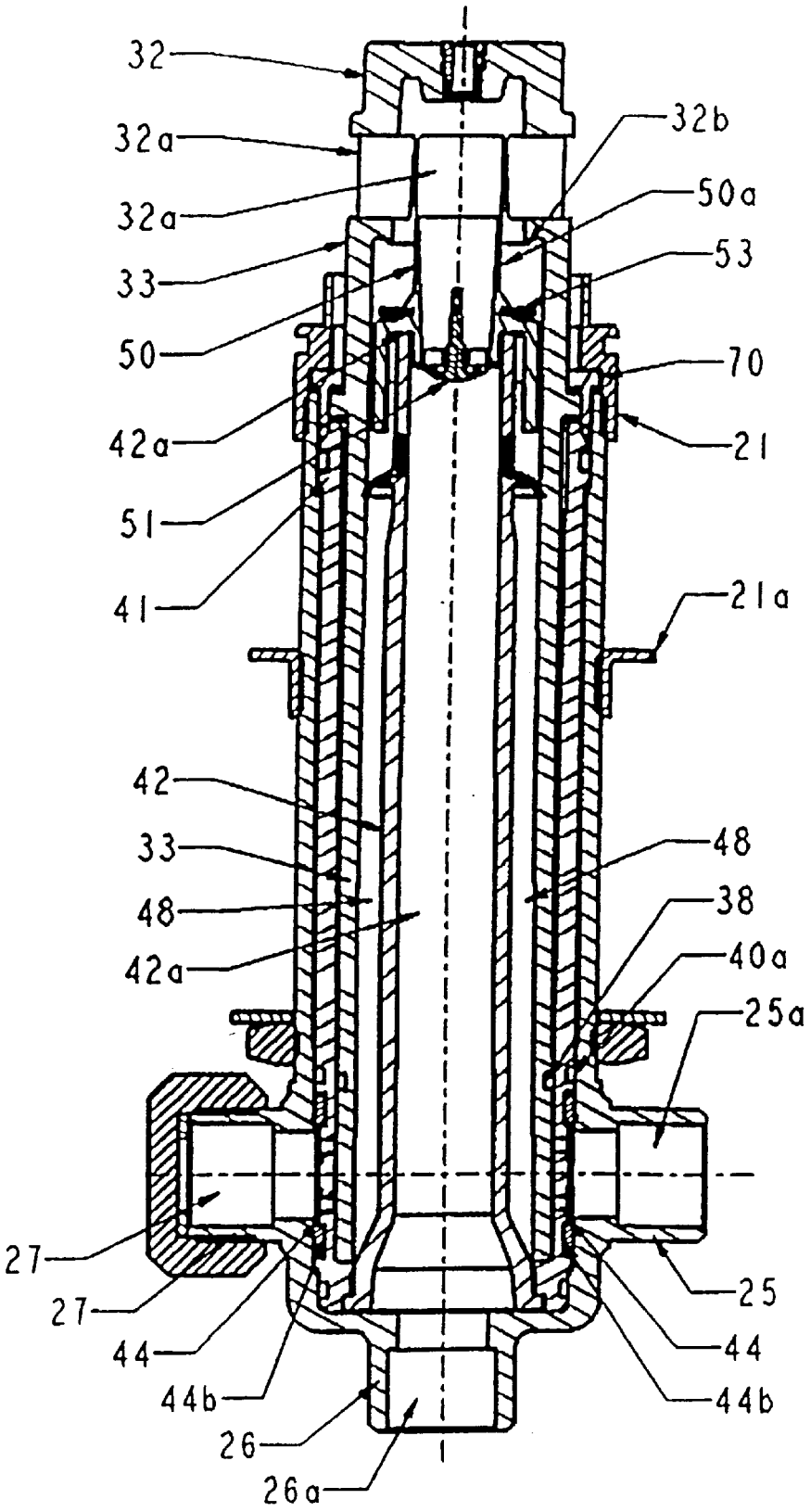
FIGS. 6 and 6*a* are cross sectional views of the entire assembly of the Diverter Valve and illustrated in a preferred embodiment of the invention.
Figure 6A:
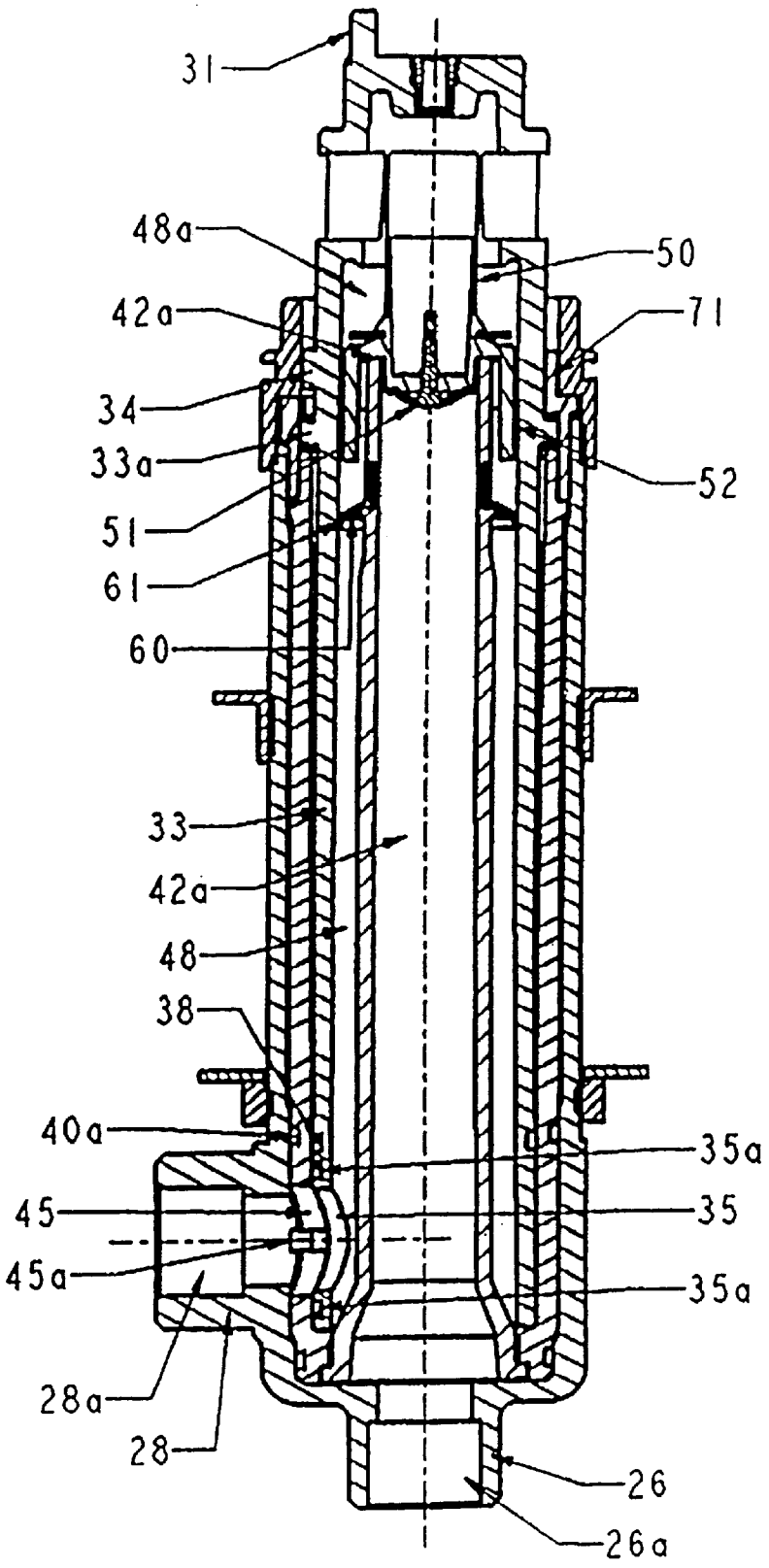
Figure 7:
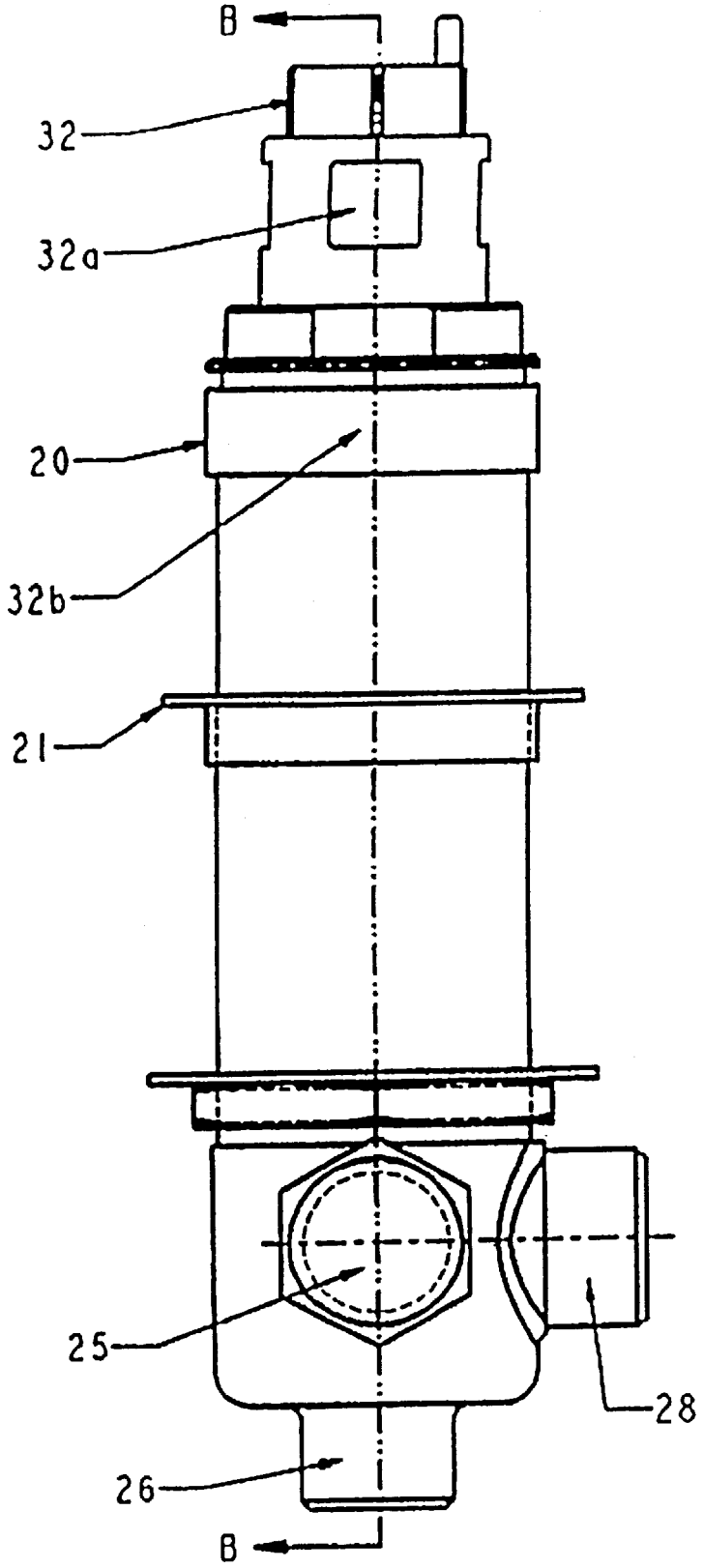
FIGS. 7, 7*a* and 7*b* are illustrations of the assembled cartridge and housing of the Diverter Valve showing the various outlets from the valve and illustrated in a preferred embodiment of the invention.
Figure 7A:
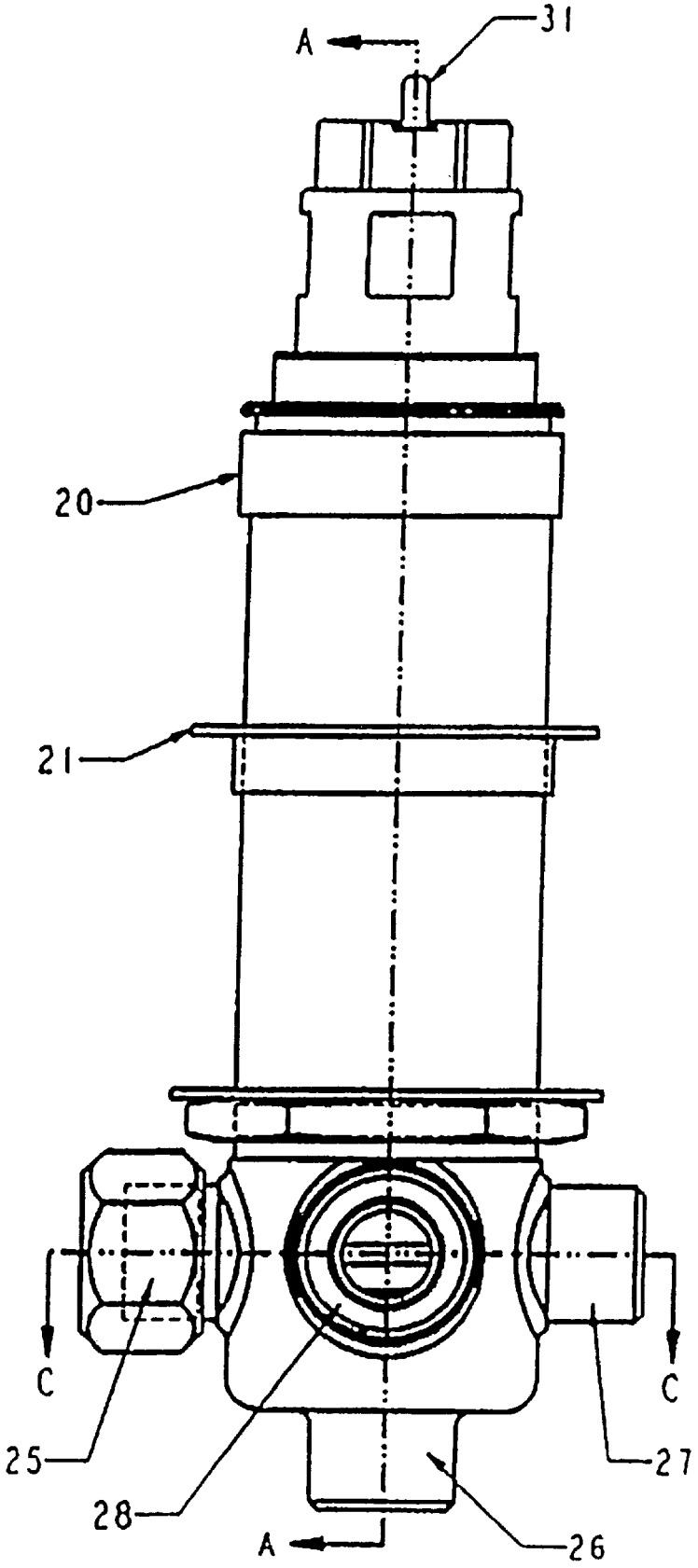
Figure 7B:
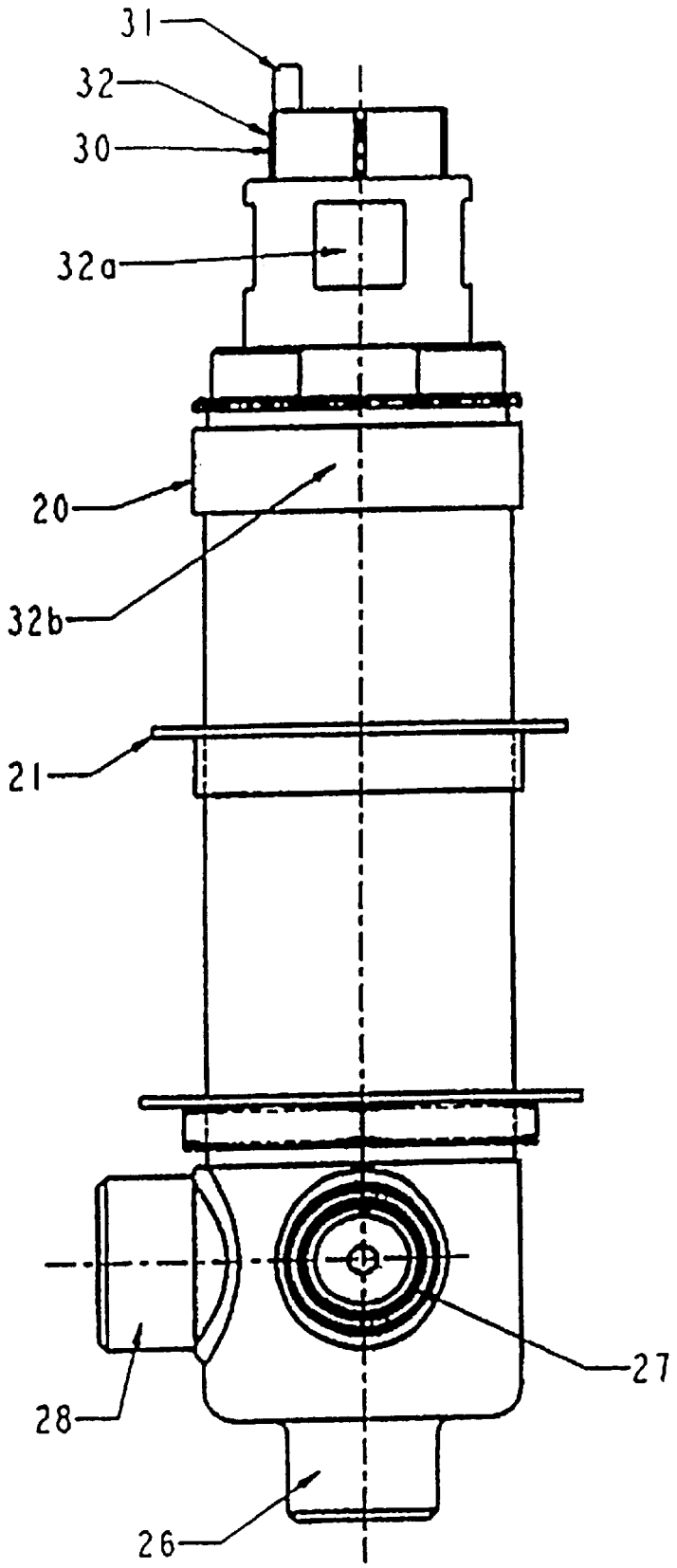
Figure 8:
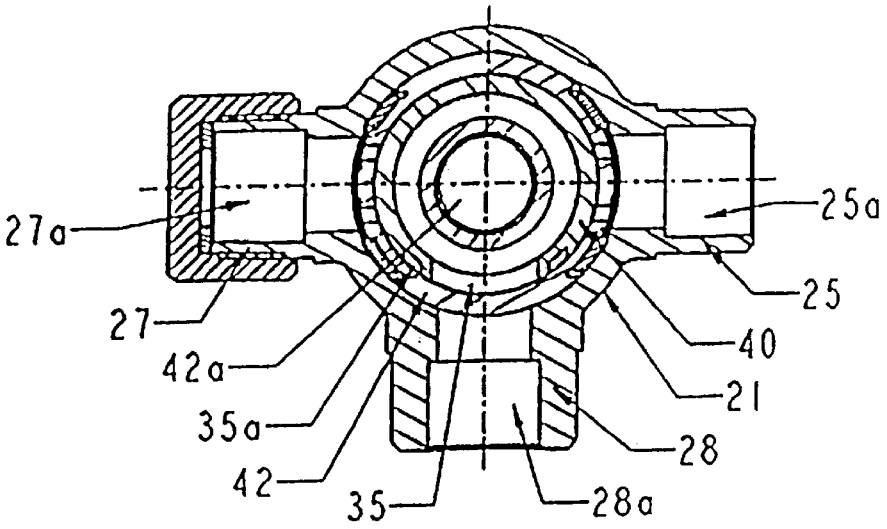
FIG. 8 is a top sectional view of the Diverter Valve assembly illustrated in a preferred embodiment of the invention.

Referring now to FIGS. 6 and 6*a* the entire assembly is illustrated in cross section with the stem 30 selecting the outlet 28 and the outlet 45 and therefore sending the water to the spout. The water will pass up the inlet tube to opening 6*a*, overflow by raising the vacuum breaker 50 so that portion 50*a* engages with opening 32*b*, sized to receive the flange or cylinder size 50*a* thereby closing the valve to atmosphere via the seal 52*a* raised against the bottom of the opening 32*b* thereby sealing the diverting valve from atmosphere and allowing water to pass over into the chamber 48*a* and selectively out of the valve. When a shower is selected typically there is a head of water retained in the shower feed pipe or telephone tubing. Since the telephone tubing is not always within the tub in a Roman tub it is preferred to prevent any dripping from the telephone shower onto for example the floor. Therefore a check valve is provided proximate the outlet as well to prevent water from passing fluid back into the valve from the telephone shower or the shower nozzle. As described in relation to FIGS. 12, 12*a* and FIG. 5*a* the vacuum breaker in essence works identically with the previously described vacuum breaker of my previous Canadian Patent 1,225,006 with the exception of enhanced features of the float and the plug 51 providing a much tighter package. When water is shut off therefore from entering the valve the Diverter Valve float 51 will close the end of the inlet tube 42*a* and therefore allow the passage of air into the valve and thereby preventing creation of a vacuum in the valve with all the known problems that this may create.

Figure 9:
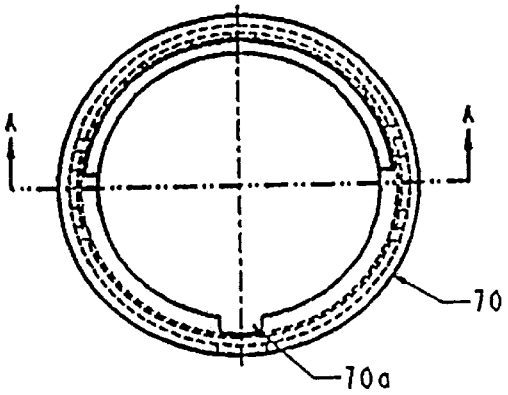
FIGS. 9, 9*a*, 9*b*, 9*c*, 9*d*, 9*e*, and 9*f* are various views of the retainer ring illustrating the various components thereof and shown in a preferred embodiment of the invention.
Figure 9A:
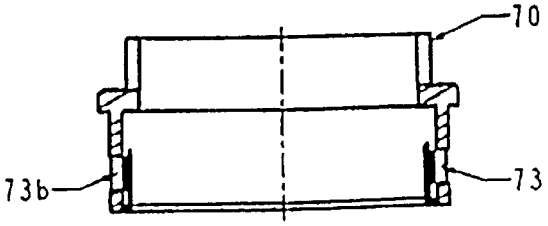
Figure 9B:
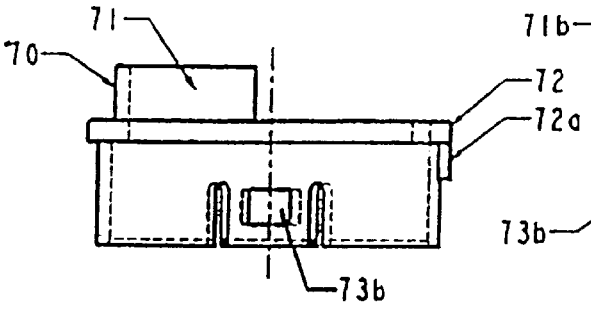
Figure 9C:
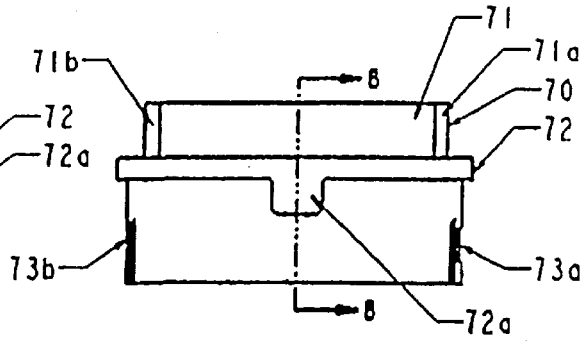
Figure 9D:
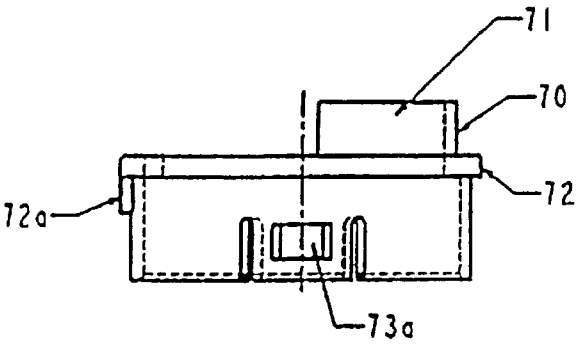
Figure 9E:
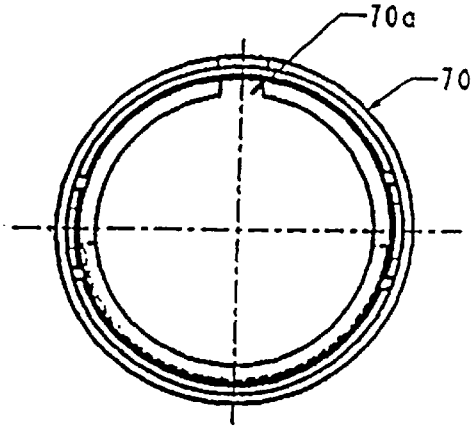
Figure 9F:
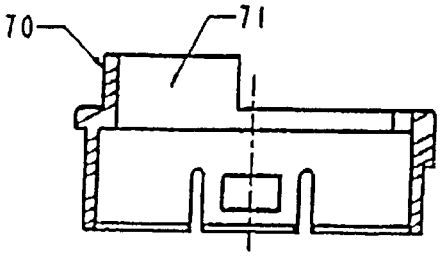

FIGS. 9 through 9*f* describe the retaining ring as previously described with all of the components thereof including an opening 70*a* and detents 71*a* and 71*b*, and detents 73*a* and 73*b* which engage with the cartridge as previously described.

Figures 10, 10A, 10B:
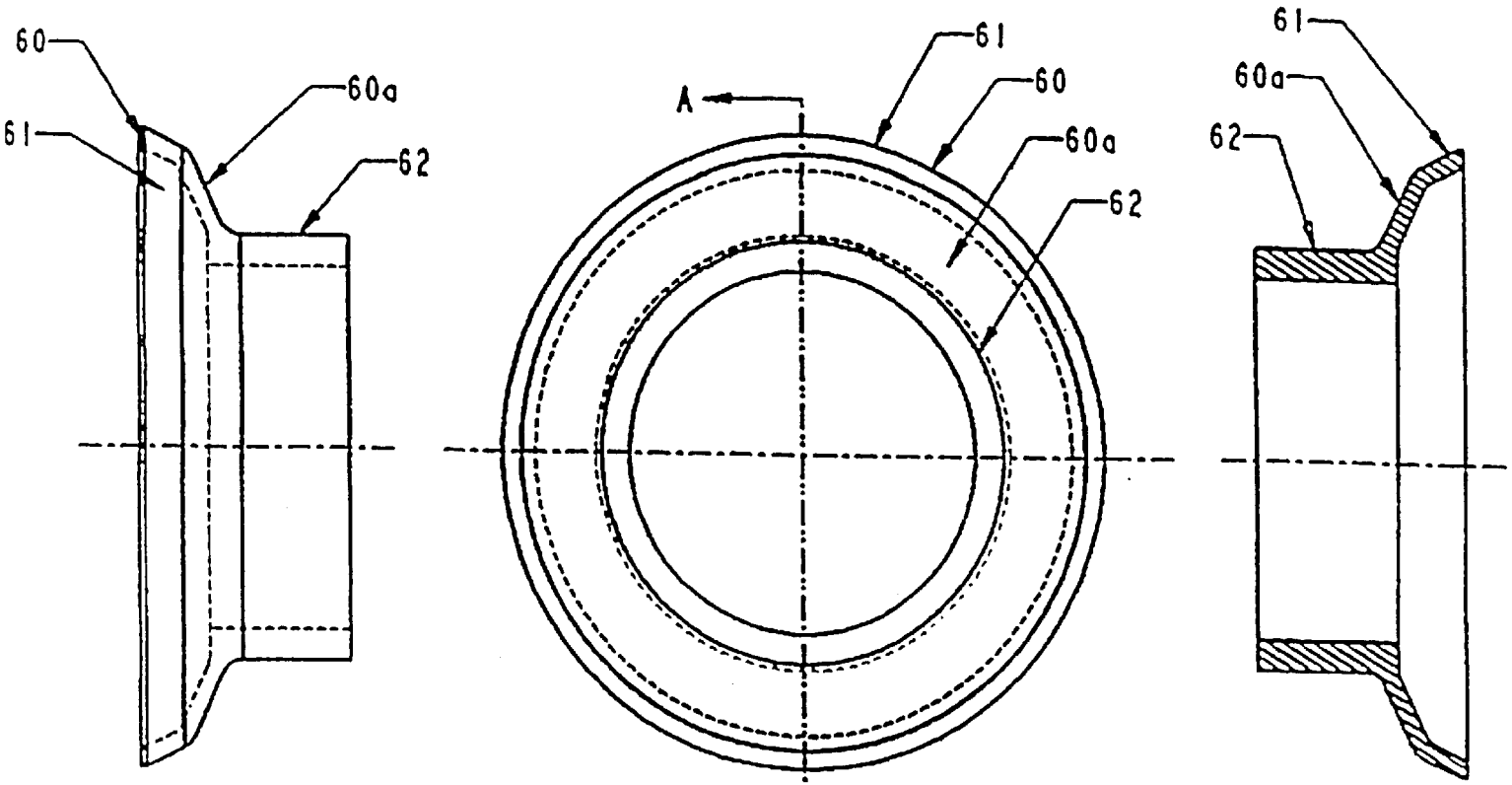
FIGS. 10, 10*a*, and 10*b* are side, top, and cut away views of the check valve for the inlet tube 42 which is illustrated in a preferred embodiment of the invention.

Referring to FIGS. 10–10*b* there is described the unique check device provided as best seen in FIG. 6*a* which includes a substantially flexible material have a shape substantially shown having a tapering bottom portion 61 and a substantially more biased tapered form 60*a* and a substantially cylindrical section 62 which butts up against the detent portion 42*b* of the inlet tube 42. The slanting surfaces 60 and 61 therefore provide the checking and tight fit. The inner diameter of the moveable diverting stem 30 and the inlet tube providing an inlet chamber 48 by preventing the passage of the fluid back from the passage 48 to the inlet tube 42.

Figure 11:
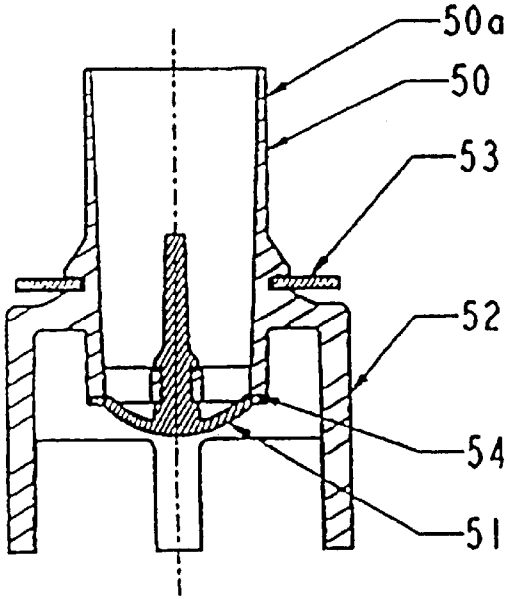
FIG. 11 is a cross sectional view of the float 50 proximate the top of the inlet tube 42 having a stopper 51 and illustrated in a preferred embodiment of the invention.

Referring to FIG. 11 there is described the float mechanism 50 having a tapered wall 50*a* in order to shut off the venting of the valve as previously described in cooperation with the seal 53 and shut off the top of the inlet tube via stop 51 and downwardly depending skirts 52. The float of course is sized to fit within the portions of the inlet tube at 54 and breather opening 42*b* at 50*a*.

Referring to FIGS. 12 and 12*a* as previously described there is provided the unique check mechanism 4 and 4*b* which retains in the opening 44 as best seen in FIG. 4*b* so that the face 44*b*(2) will prevent any fluid from re-entering the opening 44*a* but the opening 44*b*(3) will allow passage of the fluid from opening 44*a* to the selected outlet. It is recommended that the material for both the checks of FIGS. 10 and 12 be made from epdm 60 duro.

Figure 14:
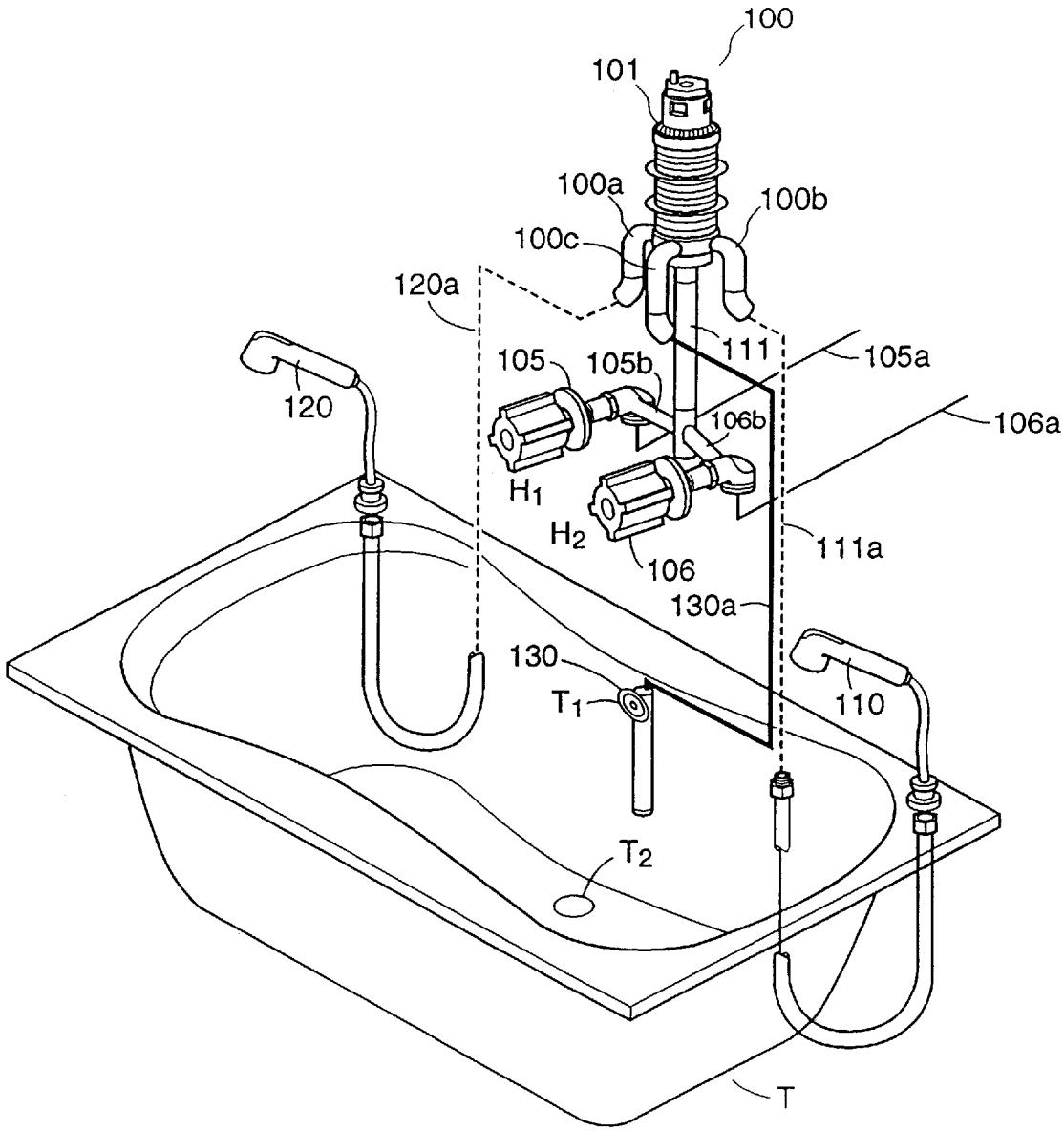
Figure 15:
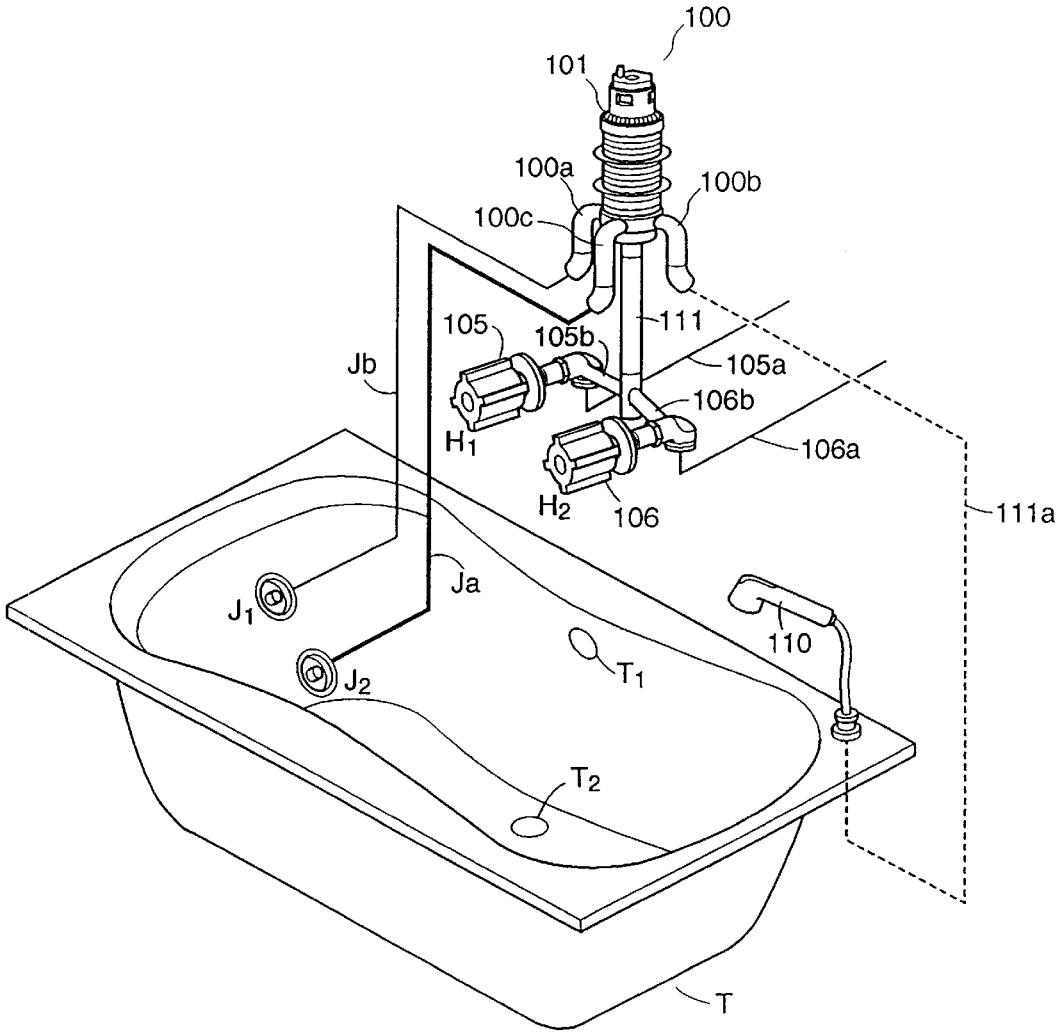
FIGS. 15 and 16 illustrate a deck-mounted tub installation including the diverter valve having a high-volume jet outlet to the tub utilized to fill the tub and illustrated in a preferred embodiment of the invention.
Figure 16:
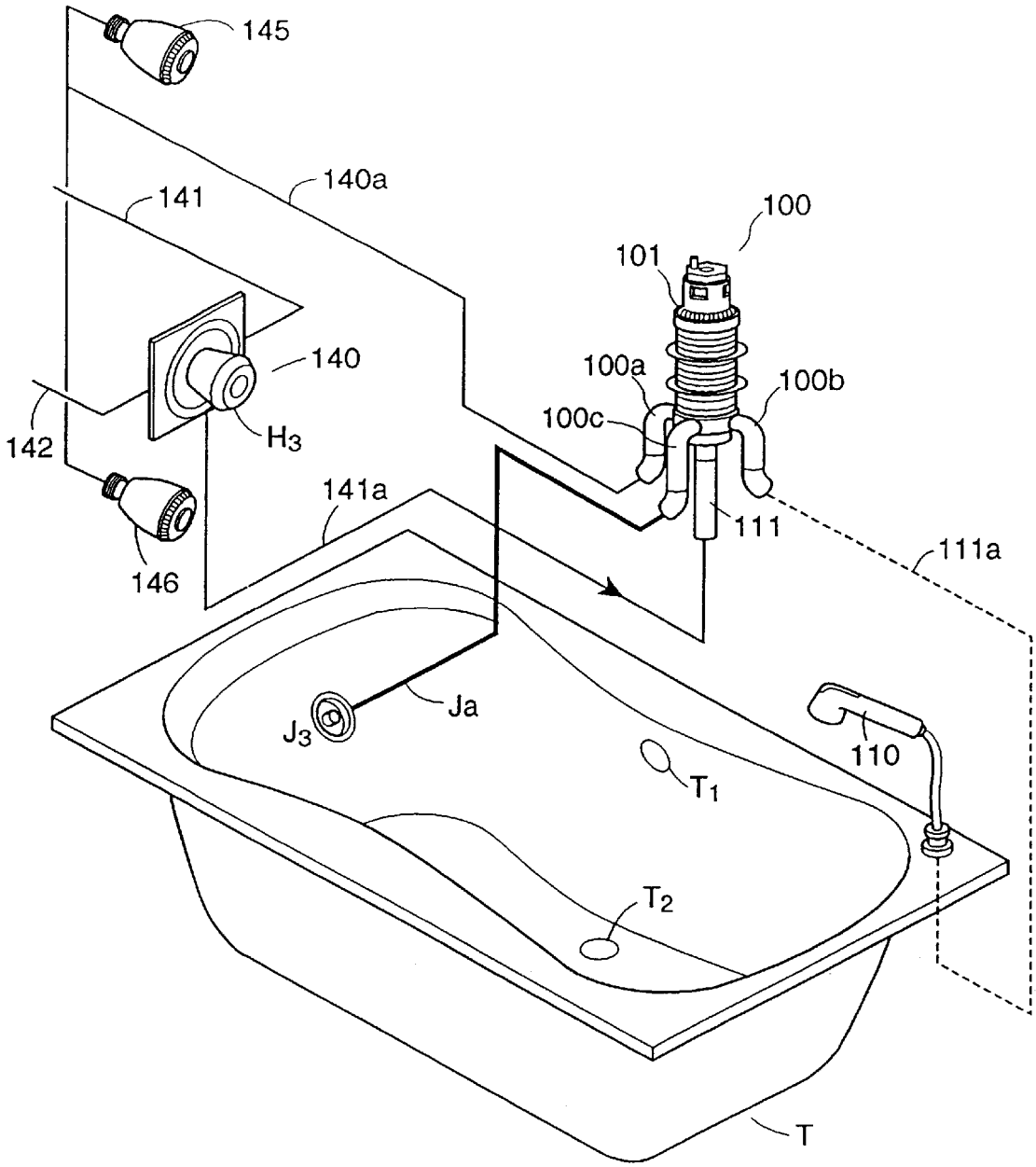

Referring now to FIGS. 1 and 13 through 19, there is illustrated various deck-mounted installations utilizing the diverting valve described herein advantageously which results in various unique tub installations heretofore unrealized, especially in view of the requirements of the building code as set out in ASME, CAN/CSA, IAPMO and CABO/ANSI (ADA) codes. Therefore, many installations heretofore impractical or expensive and uneconomical may be realized such as spas, Roman tubs, soaking bath tubs, whirlpools and the like. The diverting valve receives its supply of water from supply valves such as those illustrated in FIG. 13 wherein the hot and cold water supply valves are separate, or alternatively from a supply valve such as illustrated in FIG. 16 which may be a single-lever spool valve. Regardless of the supply, the water therefore enters at the bottom of the valve into the cartridge as previously described and may be diverted to any of the three outlet ports at 100*a*, 100*b* or 100*c*. The diverting valve 100 therefore is positioned appropriately to the desired outlet. The outlets 100*a* and 100*b* are somewhat restricted in all embodiments described herein having a maximum flow of approximately 11 gallons per minute at 60 psi. The spout outlet 100*c* has a capacity of 30 gallons per minute at full flow. The restrictions in the cartridge which lead to the outlets 100*a* and 100*b* and the integral checks as best seen in FIG. 4 results in the limited flow capability of eight gallons per minute of these outlets versus the full flow substantially as illustrated in FIG. 4A which leads to the outlet 100*c* in all embodiments. At 30 gallons per minute, the copper tubing normally connected to the diverting valve of this installation is typically ½" to provide the full-flow and quick-fill capability of the tub in each of the embodiments of the invention illustrated herein. Most embodiments take advantage of the three position diverting valve 100. Equally the diverting valve may have more than three positions, but for simplicity of illustration, only three positions are described. Another important aspect of the code is that there be no stagnant water. So in, for example, FIG. 17, although a three-position valve is provided, both of the auxiliary outlets 100*a* and 100*b* are joined together to flow to the hand-shower 120. Another advantage of the present invention utilizing the diverter valve is the fact that the water does not have to be closed off from the water supply valves in order to re-direct the water. The diverting valve provides both the low-flow option and the high-pressure option to flush all of the systems and remove the risks of contamination of any stagnant water. The deck-mounted valve is accessible to repair from the deck and not from the bottom in all installations and embodiments. Only the whirlpool installations require a separate check valve to prevent contamination of potable water since the full-bore 30-gallon per minute outlet from the diverting valve does not have a check provided normally, since in most instances the water from this port is directed to a spout. Where full volume flow is connected to an outlet, pump or the like which is below the flood rim of the deck, it is recommended that an auxiliary check valve be used. Great savings therefore can be realized in the cost of installation. Three separate checks and vacuum breakers are avoided by providing them within the valve on the inlet and two on the auxiliary outlets. The labour and material savings have also been realized in comparison to installing separate checks and vacuum breakers on those lines as well as the maintenance costs should these separate component valves break.

Figure 13:
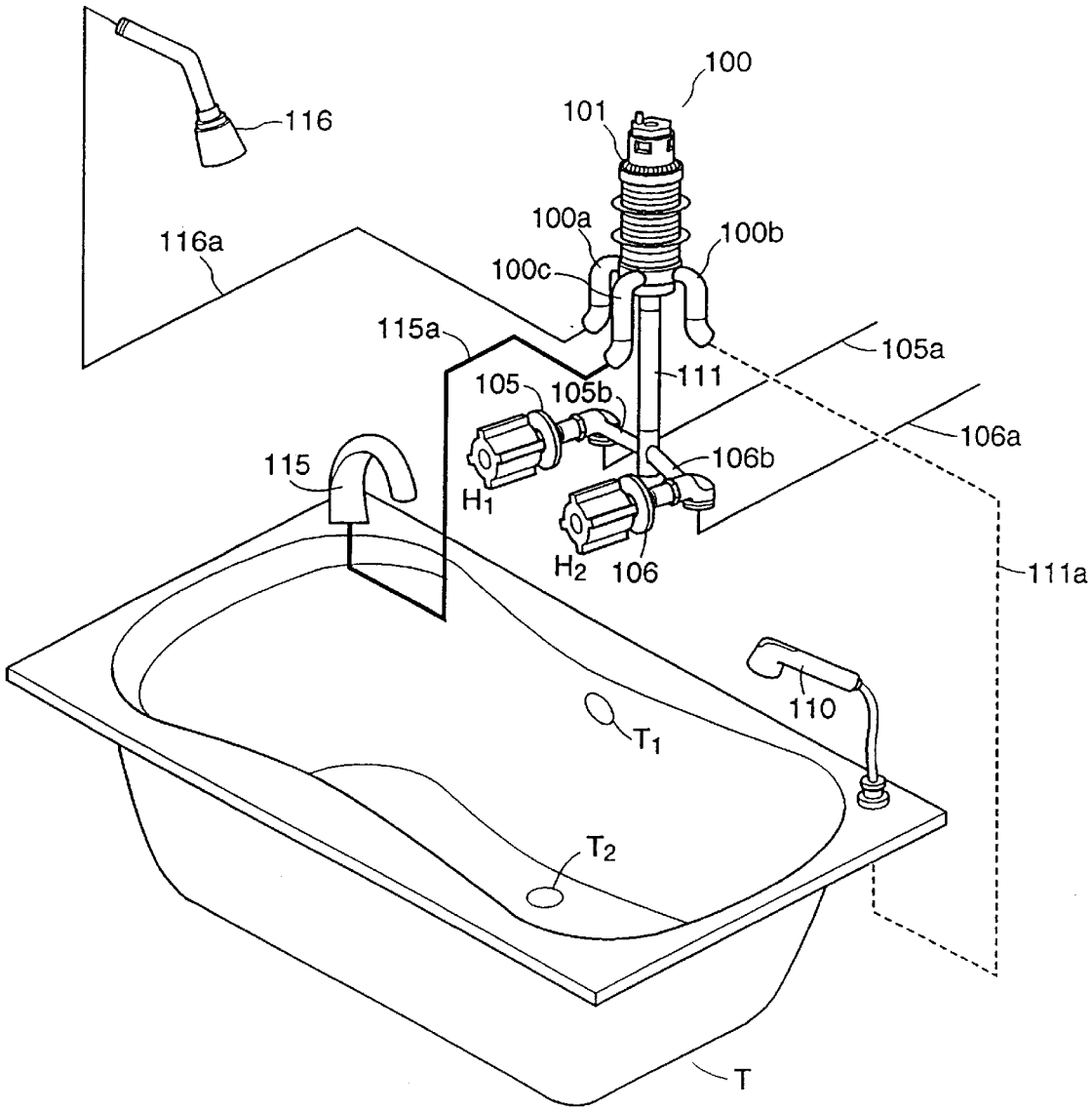
FIGS. 13 and 14 illustrate a deck-mounted tub installation utilizing separate water supply valves to supply the diverter valve illustrated in preferred embodiments of the invention.

Referring now to FIG. 13 and FIG. 1, the diverting valve 100 of the invention described above is installed on a deck and is supplied through supply line 111 which extends from the separate valves 105 and 106 for hot and cold water supplied through inlets 105*a* and 106*a* respectively. The water is carried from each separate valve 105 and 106 along lines 106*b* and 105*b* to the supply line 111 going into the bottom of the diverting valve 100 as best seen in FIG. 1 then passing through the cartridge assembly of the diverting valve as previously described as best seen in FIG. 2 having integral vacuum breaker and check on the inlet supply. The cartridge is operated by the bather (not shown) which engages the stem portion 32 as seen in FIG. 3 in a conventional manner. Then the handle therefore is operated, it may be positioned by the user at three positions, one for water to exit via the main high-volume supply outlet at 101*c* which does not have a check wherein the fluid flows through line 115*a* to the spout 115 to fill the tub. Alternatively, the operator may position the diverting valve to outlets 101*a* or 101*b* so that the water may flow to either outlet 100*a* and 100*b* connected to feedlines 116*a* and 111*a* respectively to go to the body shower 116 or the hand shower 110. The tub T is provided with an overflow at T1 and a drain at T2 as is well known.

FIG. 14 illustrates an embodiment similar in every respect to that illustrated in FIG. 13 with the exception that the shower 116 is replaced by a second hand-held shower at 120. The operation of the diverting valve is identical. The tub includes all of the limitations previously described in 13 as well. Advantageously, however, the full-flow outlet port of the diverting valve 100 at 100*c* is connected via the line 130*a* to a filled port 130 located in the waste overflow T1 of the tub T. The spout therefore of the embodiment of FIG. 13 is eliminated allowing for the filling of the tub to be accomplished through the waste overflow. However, to provide contamination protection, check valves and vacuum breakers are included and embodied in the feed line from the outlet at 100*c* or within the cartridge itself which is preferred. The installation includes two hand-held showers 110 and 120 which may include quick-connect, high-pressure, stainless-steel-braided hoses and trim accessories to allow for use of the high pressure and the high temperature capabilities of the valve of 160° F. and 125 psi maximum operating temperature and pressure. This installation still meets all of the code requirements specified above.

Referring now to FIGS. 15 and 16, there is illustrated the use of jets J1, J2 and J3 to fill the tub T. The jets J2 and J3 are connected to the high-volume outlet port 100*c* of the diverting valve 100. The lines ja therefore lead to this high-volume jet to allow for mixing of the hot water to obtain a uniform temperature in the tub. This is advantageous over the use of a spout so that the water is well mixed in the tub for the bather. A supplementary jet J1 is provided in FIG. 15 from one of the auxiliary outlets 100*a* along a supply line Jb to allow for a lower-volume fill proximate the top of the tub once the primary amount of water has entered the tub. This allows for slow mixing of the water into the tub. The jets may be advantageously used as is normally expected for massaging one's back or the like without the provision of a pump. The hand-held shower 110 is provided via the supply line 111*a* at auxiliary outlet 100*b* for both installations of FIGS. 15 and 16. However, since the supply valve in FIG. 16 is a single-lever spool valve having either thermostatic temperature control or pressure-balancing spool volume control, the main supply therefore to the valve is accomplished in the desired manner. The diverting valves therefore may be alternatively directed to a body shower in FIG. 16 via supply lines 140*a*. The handle H3 therefore is operated and positioned appropriately so that the supply of cold and hot water through inlet supply lines 141 and 142 enter the spool valve, which may be of any construction. The water supply therefore goes from the spool valve through the outlet thereof to the inlet 111 via the supply line 141*a* to the diverting valve of the present invention. The water is then diverted to outlets 100*a*, 100*b* or 100*c* as desired by the bather. A deck-mounted tub installation therefore is provided with the supply of water entering through the jets J1, J2 or J3 individually or sequentially utilized by the bather. The spout is therefore eliminated again in these installations with superior mixing of the hot water and cold water into the tub and the provision of a jet feature without the need of a pump.

Figure 17:
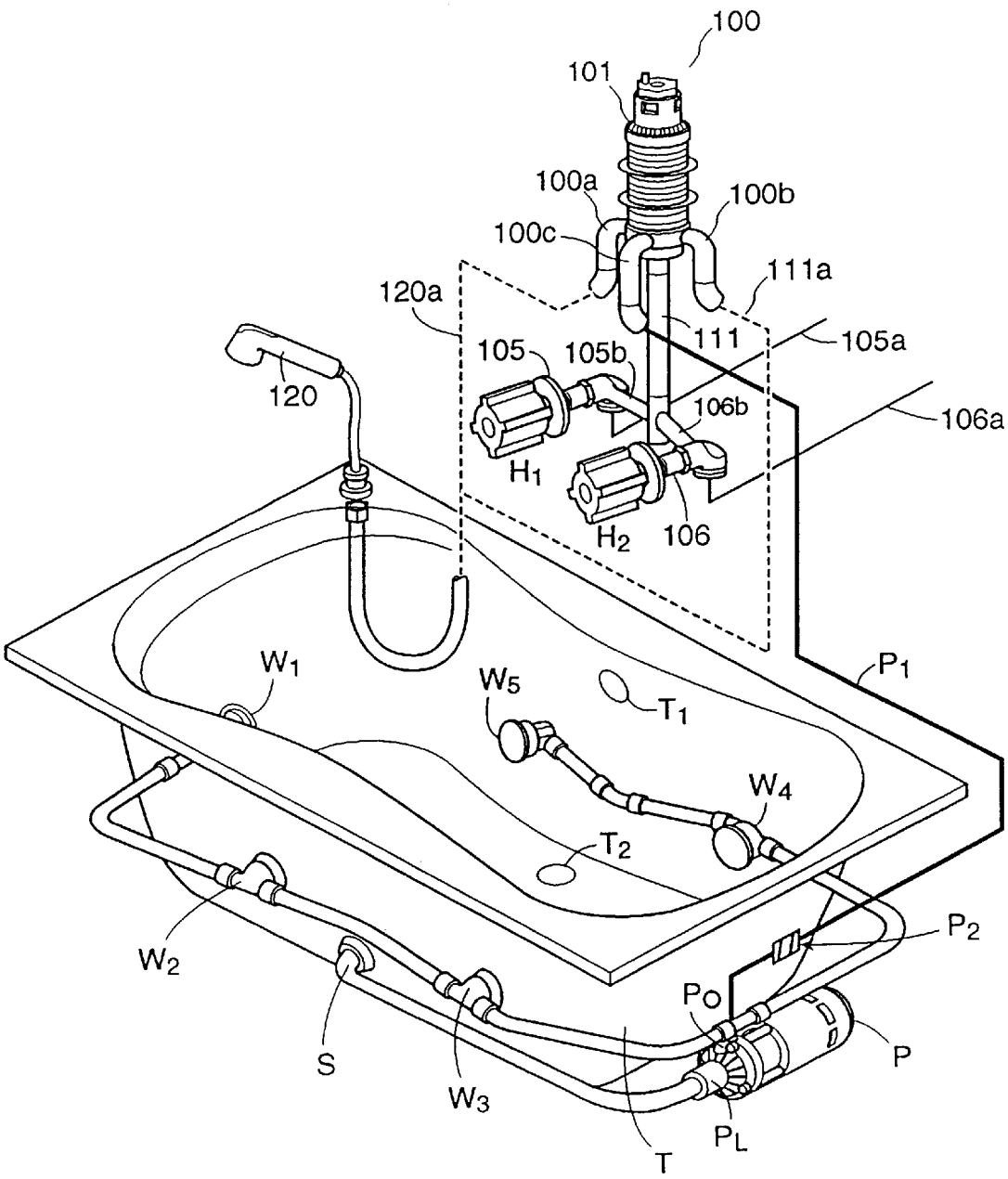
FIGS. 17, 18 and 19 illustrate a deck-mounted tub installation utilizing the preferred diverting valve and including a whirlpool tub and necessary jets connected to the main high-volume outlet line of the diverting valve and illustrated in a preferred embodiment of the invention.
Figure 18:
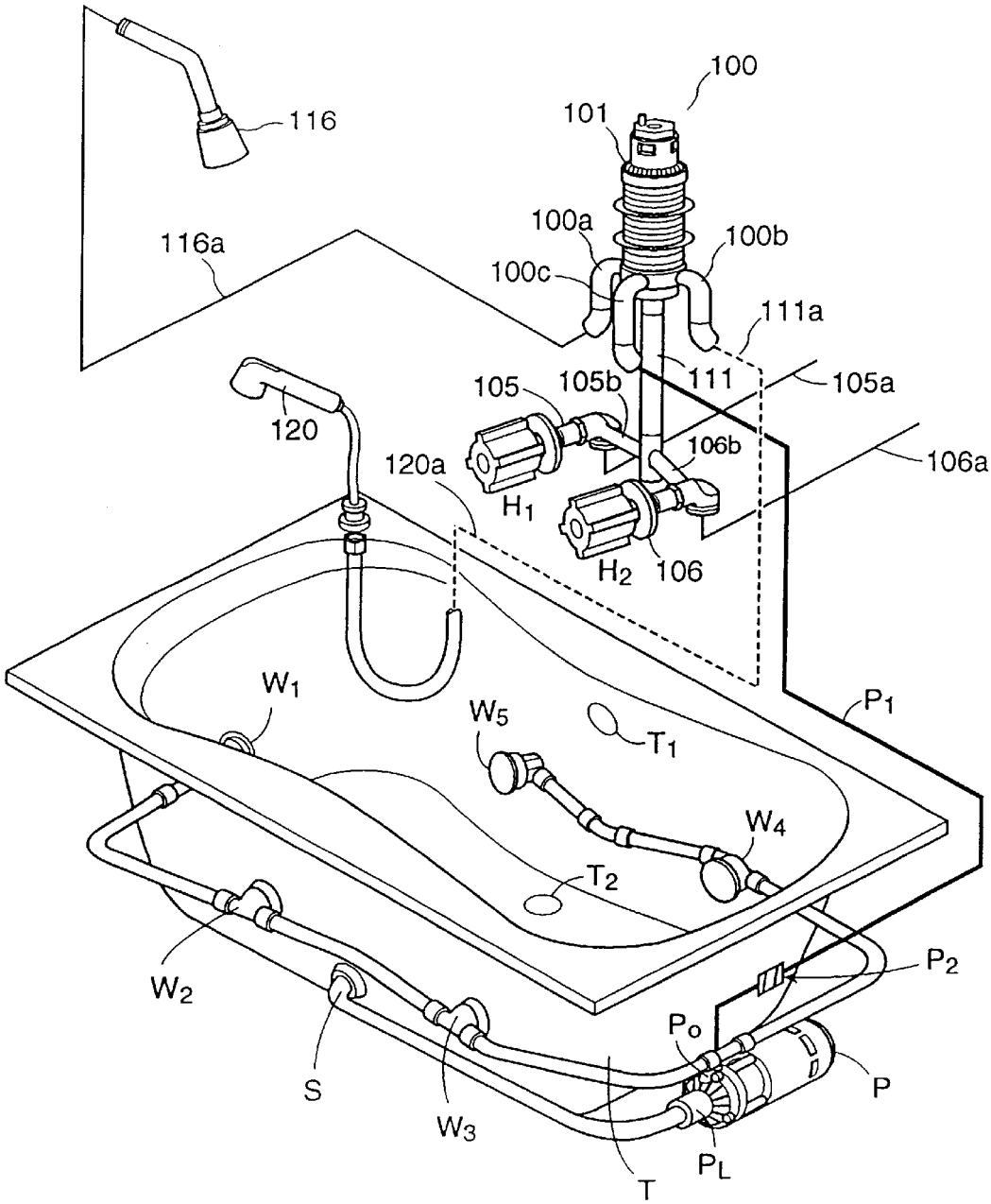
Figure 19:
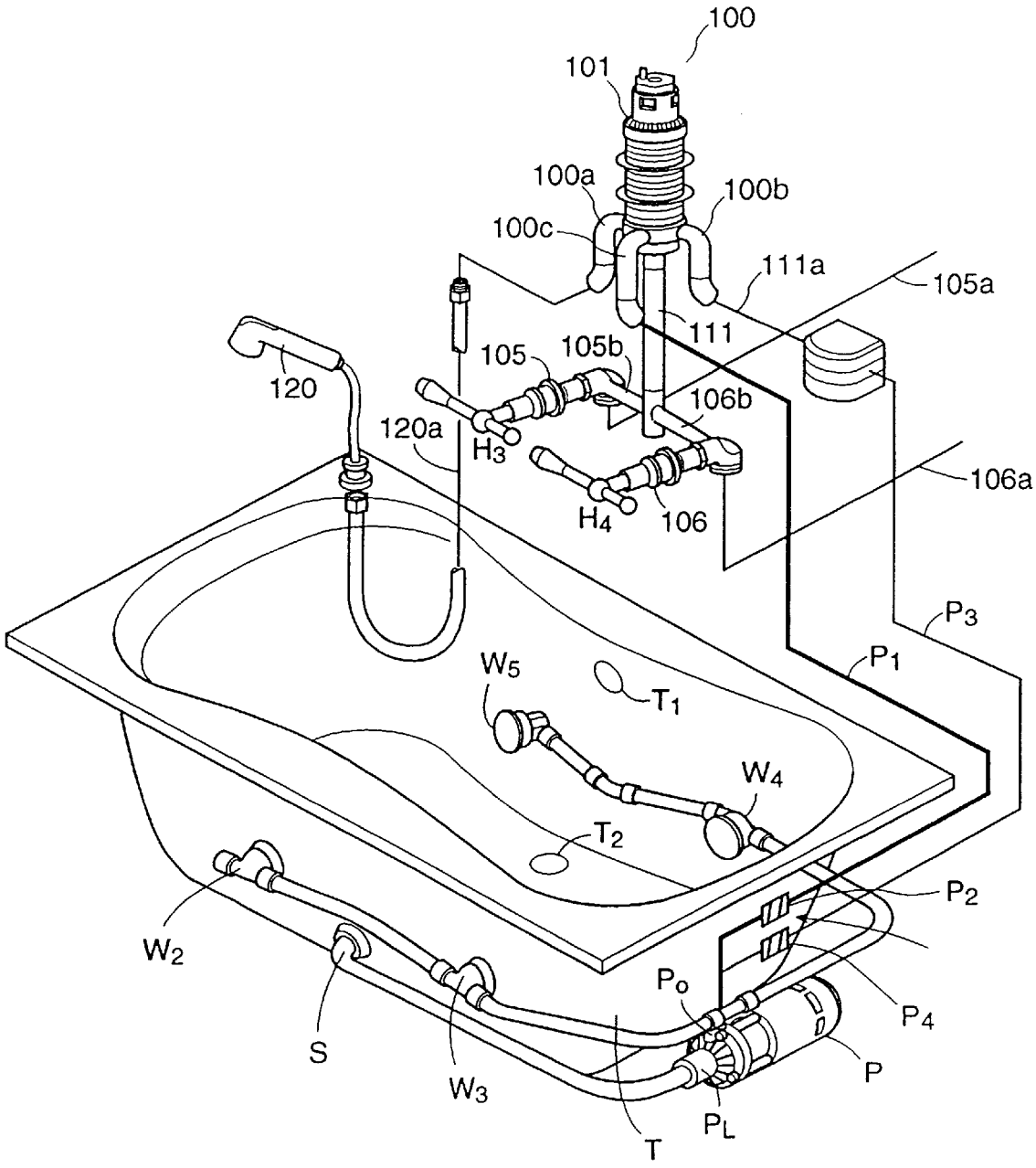

Referring now to FIGS. 17, 18 and 19, there is illustrated the diverting valve of the present invention 100 having the handle access ring 101 and the outlets 100*a*, 100*b* and the full-flow 100*c* outlet. In each instance, separate valves 105 and 106 are provided which provide hot and cold water through the inlets 105*a* and 106*a* respectively to the supply line 111 into the bottom of the diverting valve 100 and through the diverting valve to the various outlet positions to which the bather can rotate the handle (not shown) to select outlet ports 100*a* and 100*b* which are the two auxiliary outlets or the main full-flow outlet at 100*c*. The main flow outlet at 100*c* is connected at 30 gallons per minute maximum to supply line P1 which leads to the whirlpool pump P at the outlet thereof P0 located adjacent tub T. The pump would therefore be secured as in any well known whirlpool installation. The tub T therefore is provided with an overflow T1 and a drain T2. Further, the tub has whirlpool jets W1 through W5 located at advantageous positions to provide the user with the beneficient aspects of a whirlpool. A suction port S is provided which leads from the supply line to the pump inlet Pi. Each of the sections of pipe connecting all of the jets W1 through W5 are as required by code. Within the supply line P1 to the pump outlet P0, a separate check valve P2 is provided. The check may be of any design as long as it prevents the pump pumping back to the diverting valve. As can be seen in FIG. 17, to eliminate any stagnant water, the auxiliary outlets 100*b* and 100*a* having low flow rates of approximately 11 gallons per minute are connected to the hand-held shower 120 via the supply lines 120*a* and 111*a*. In FIG. 18, the addition of a body shower 116 therefore requires that the auxiliary line 116*a* be connected to body shower 116 and the line 120*a* be connected to the hand shower 120. Otherwise, the installations contained in FIGS. 17 and 18 are identical. The operator therefore would adjust the handles H1 and H2, and H3 and H4 in FIG. 19 to provide the correct temperature mix of the water. The diverting valve 100 would therefore divert the water to the full-bore outlet 100*c* at maximum outlet pressure and flow at 30 gallons per minute along the outlet line P1. The outlet line P1 connects to the outlet from the pump to the supply lines leading to the jets W1 through W5 respectively. The pump and the jet including the piping system will be cleaned and flushed every time before the whirlpool will be put to use. Further, the tub would therefore fill the whirlpool through the jets. The tub would therefore be filled to the desired level and the water supply would then be shut off. The pump P would therefore be started drawing water from the suction port S to the pump inlet and pumped back through the outlet Po to the whirlpool jets. The check valve P2 therefore would prevent back flow of potable water through supply line P1. The bather may then enter the tub and may make use of the hand shower of FIG. 17 or the body shower of FIG. 18 by redirecting the water to the outlet 100*a* without shutting off the water if desired. The hand-held shower 120 or the body shower 116 may therefore be utilized while the whirlpool is operating. If a body shower nozzle 116 is not desired, or if the diverting valves are included with a fourth low volume auxiliary outlet which is not illustrated, a disinfectant circuit may be provided with the valve assembly as is best seen in FIG. 19. For purpose of illustration only, the body shower outlet 116 is eliminated and the outlet 100*b* is connected to a disinfectant circuit P3 which includes a disinfectant container C which circuit P3 is connected via a T connector to the line P1 supplying the pump P. The line P3 therefore has a check P4 located therein so that the disinfectant line is sanitary at all times and it will preclude back flow to the diverter valve. Prior to bathing or following bathing, the bather may position the diverting valve so that the water passes through the outlet 100*b* through a disinfecting container C which includes a "puck" or like disinfectant (which may be in any convenient form) for one-time use which had been previously placed within the disinfectant container. The water therefore passes through the disinfecting container C and dissolves the disinfectant materials (not shown); the disinfectant travels with the water flow along supply line T3 through the pump then to the whirlpool piping system and jets at a low-volume rate of 11 gallons per minute. The disinfectant cannot back flow to the main supply line P1 to the valve or through the supply line P3. It has no alternative but to go through the whirlpool system, then to the tub. The tub is filled above the whirlpool jets W2 through W5, and once the desired level is obtained, the water flow is stopped, the pump is turned on and the jets connecting the jets and the suction supply line to the pump P are all disinfected. The tub is then drained and ready for use. Further, within FIG. 19, more glamorous hardware is provided with the valve assembly at handles H3 and H4. Otherwise, the installation is similar indeed to FIGS. 17 and 18. The disinfectant circuit is a necessity to meet health code requirements primarily for hospital, institutional and hospitality installations or the like. Of course, it may be used domestically as well. However, the invention finds particular use in all of these deck-mounted installations and eliminates the need for separate piping lines, check valves and vacuum breakers unless otherwise required. This is a great savings in installation cost, easy to maintain, and yet all code requirements are easily met by these installations.

As many changes can be made to the preferred embodiments of the invention without departing from the scope of the invention; it is intended that all material contained herein be interpreted as illustrative of the invention and not in limiting sense.

The embodiments of the invention in which an exclusive property or privilege is claimed are as follows:

1. A cartridge for a valve housing having outlets, the cartridge comprising a stationary body sleeve for fixed insertion within the housing and having outlet ports permanently aligned with the outlets of the housing, a moveable substantially hollow stem sleeve inserted within the stationary body sleeve and having an opening selectively alignable with the ports of the stationary body sleeve, the body sleeve and hollow stem being connected to one another by a retaining ring which aligns and maintains the cartridge as a unit in the housing.

2. The cartridge of claim 1 installed as a deck mounted fixture in one of a group selected from a tub, whirlpool, soaking bath, spa, and roman tub, each one of said selected group having a tub spout, wherein the tub spout is located below the flood line rim of the respective fixture wherein the cartridge can be repaired by replacing the cartridge from the top of the fixture by removing a handle and replacing the cartridge in its entirety.

3. The cartridge of claim 1 installed in a tub assembly further comprising a spout, and a stem for selective alignment of the outlet of said cartridge and one of a group selected from said spout, a hand-held shower and a body shower.

4. The cartridge of claim 1 installed in a tub assembly further comprising a waste overflow having an inlet to the tub positioned within the waste overflow and for selective alignment with the outlet of said cartridge, and one of a group selected from said inlet, and a hand shower nozzle.

5. The cartridge of claim 1 installed in a tub assembly having a top and bottom further comprising a high volume jet nozzle, positioned proximate the bottom of said tub, for selective alignment with an outlet of said cartridge, a low volume jet nozzle being positioned intermediate the top and bottom of the tub above the horizontal plane of the high volume jet nozzle for selective alignment with an outlet of said cartridge, and a hand-held shower nozzle for selective alignment with an outlet of said cartridge wherein utilizing the high and low volume jets, the user can refresh the tub water with hot water below the waterline to provide much more uniform mixing of the water and comfort to the bather providing a more uniform water temperature throughout the water contained in the tub as opposed to the water temperature of a tub of water filled only from the top through a spout.

6. The cartridge of claim 1 installed in a tub assembly further comprising a whirlpool pump having an inlet and an outlet whose inlet is for selective alignment with an outlet port of said cartridge, wherein a check is provided in the connection between said pump and said outlet port of said cartridge, the outlet of said pump being connected to a predetermined number of whirlpool jets disposed in said tub and the inlet of said pump being connected to a suction port provided in said tub to circulate the water in a conventional manner, a hand-held shower nozzle is provided for selective alignment with outlets of said cartridge to prevent stagnant water from accumulating, an auxiliary check valve being provided on the supply line to the pump to prevent contamination of the potable water.

7. The cartridge of claim 6 wherein a disinfectant dispenser including a circuit is provided having a disinfectant container on the low volume auxiliary line for selective alignment with an auxiliary outlet port of the cartridge, a check being provided in the auxiliary line to protect the water supply backing up from the pump and wherein said disinfectant may be provided in suitable form and placed in the disinfectant container for one use only, as the water passes through the container, the disinfectant is dissolved and fed directly to the pump outlet and whirlpool jets and coincidentally to the tub without the pump running if desired, the tub may therefore easily be disinfected after each use as required in hotels, hospitals and other institutions.

* * * * *